US005159749A

United States Patent [19]

Weigert et al.

[11] Patent Number: 5,159,749

[45] Date of Patent: Nov. 3, 1992

[54] WIRE TRANSFER DEVICE FOR LEAD MAKING MACHINE

[75] Inventors: Fidelo Weigert, Durrwangen; Matthias G. Reininger, Wort/Ostalbkrs., both of Fed. Rep. of Germany

[73] Assignee: AMP Incorporated, Harrisburg, Pa.

[21] Appl. No.: 646,979

[22] Filed: Jan. 28, 1991

[30] Foreign Application Priority Data

Jan. 29, 1990 [GB] United Kingdom ..... 9001999

[51] Int. Cl.[5] ..... H01R 73/04

[52] U.S. Cl. ..... 29/742; 29/747; 29/749; 29/753; 29/755; 29/757

[58] Field of Search ..... 29/759, 747, 749, 742, 29/753, 755

[56] References Cited

U.S. PATENT DOCUMENTS 4,380,117 4/1983 Brandenie et al. ..... 29/742
4,572,248 2/1986 Pegram et al. ..... 140/92.1
4,835,844 6/1989 Gerst et al. ..... 29/474

FOREIGN PATENT DOCUMENTS

89/05047 6/1989 PCT Int'l Appl. .

*Primary Examiner*—Carl E. Hall
*Attorney, Agent, or Firm*—Eric J. Groen

[57] ABSTRACT

A wire transfer device for a harness making machine includes feed tracks (24) which carry a plurality of shuttle members (30). The shuttle members (30) are pushed down the tracks (24), and incrementally push the next shuttle member (30) further down. The shuttles (30) carry the wire for the harness further down the track (24) to further wire processing stations. When the wire shuttles (30) reach the elevator member 28, the shuttle member (30) is lowered to the level of the lower track (22), where it is pushed in the opposite direction via the air cylinder (34). The shuttle members (30) are thus continuously moving in a closed loop to move wires from a pick up position to a further processing station.

19 Claims, 26 Drawing Sheets

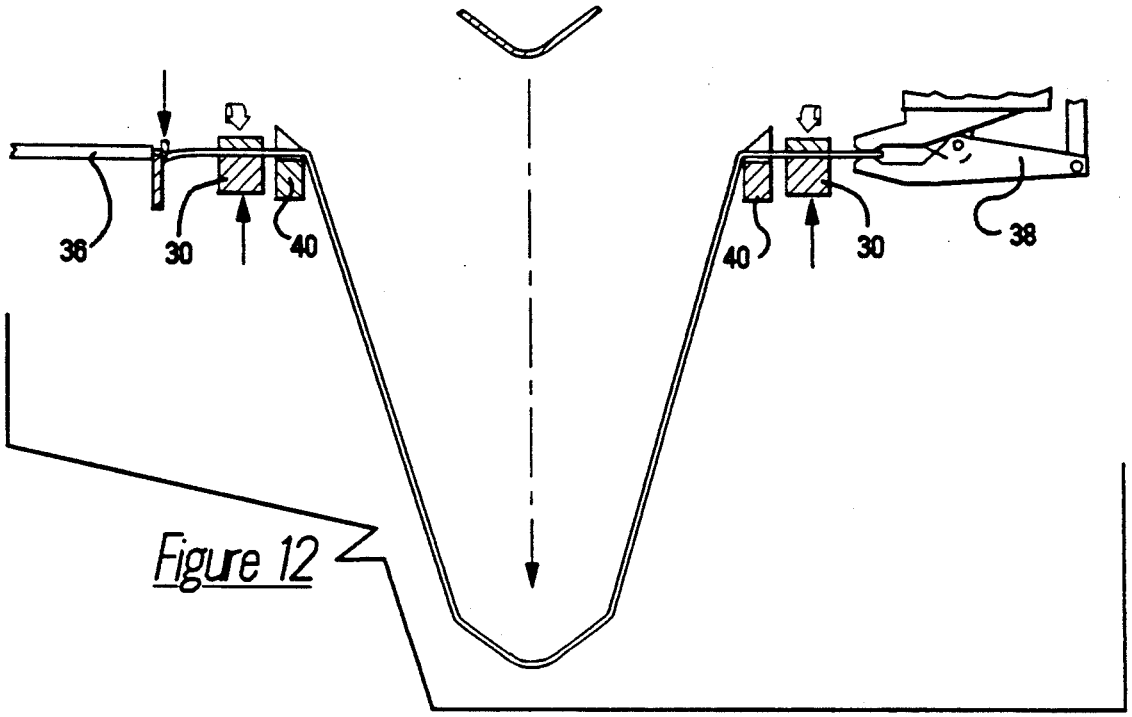
Figure 12
Figure 13
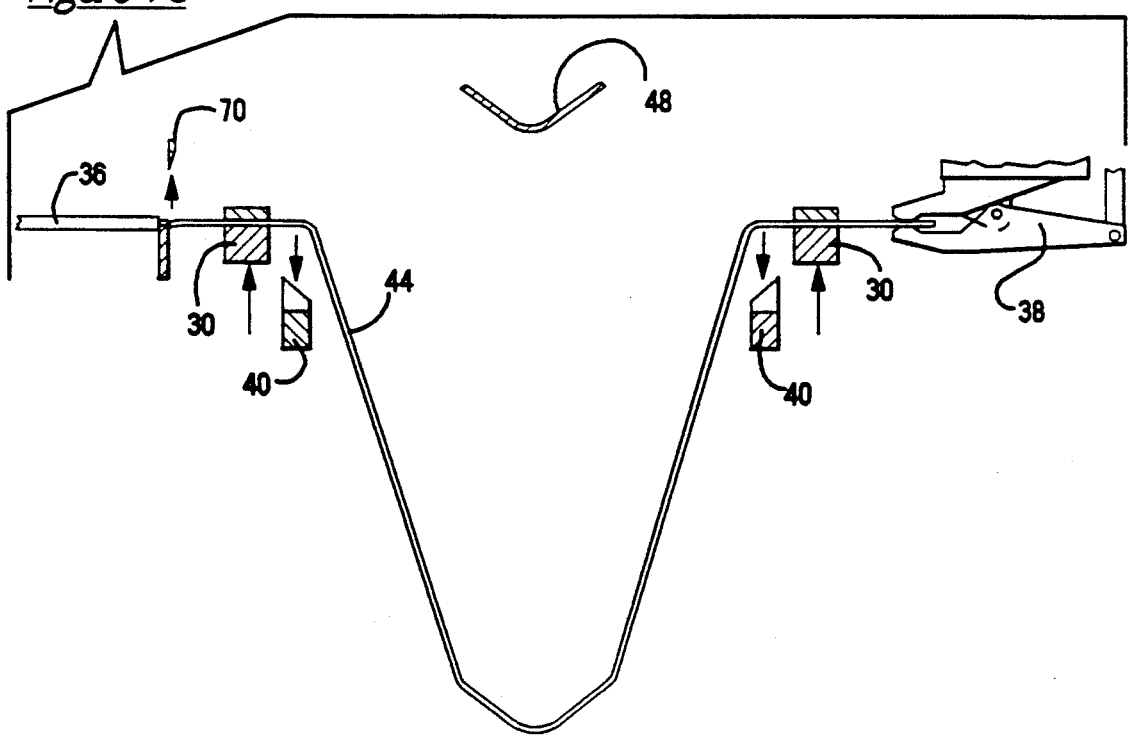

250
300
32a
32
294
296
292
34
34a
270

56
58
66
64
66

66
60

66
62

52
54
59
64
37
37
30
58
56
38
38
60
56
52

WIRE TRANSFER DEVICE FOR LEAD MAKING MACHINE

FIELD OF THE INVENTION

The subject invention relates to a wire transfer device for a harness making machine, and more particularly, a device to shuttle sets of wires in a predetermined array to further processing stations.

BACKGROUND OF THE INVENTION

It is desirable in harness making machines to process the wires to a desirable array of fixed and spaced wires, such that the wires can be further processed into harnesses, for example the wires are placed into crimping machines to electrically connect the wires with the electrical connector. It is important then that the wires be spaced to their determined spacing, and that the wires are moved, in that fixed array, to the further processing station.

U.S. Pat. No. 4,835,844 discloses a lead parking and sorting station 2 comprising two pairs of jaw wheels 12 and 16 where each of the jaw wheels 12 and 16, have on their outer circumference, lead jaws 13. The jaws 13 are actuable as shown in FIG. 3*f* to clamp and discharge a lead of a cable. As shown in FIG. 3*a*, the wheels 12, for example, hold the leads L adjacent to their ends, with the terminals T located on the outside of the wheels 12. The leads L are brought into registration with the lead clamps or jaws 13, via conveyor jaws C. The jaw wheel 12 is rotatable in the direction of arrow J to move consecutive jaws 13 into registration for pickup of a lead L, from the conveyor jaws C. When the jaw wheel 12 has the full extent of jaws 13 filled, for the particular connector housing concerned, the jaw wheels 12 and 16 can revolve, in the direction of arrow M, to exchange the positions of the jaw wheels 12 and 16. When jaw wheel 12 is now moved to the discharge position, where each lead L is brought into registry with a jaw assembly 20 of the terminal positioning and rotating station 4.

PCT Publication number WO 89/05047 discloses a cable making apparatus where wires 1 are gripped by members 14, and fed through tubes 11, and header device 15. The header device is moveable to a position where it abuts the wire spacer member 21. The wires, at the fed end are cut and terminated to connectors 2 within the track 46. The other ends of the wires are positioned within a coil spring 41, and the ends of the wires 1 are taped to maintain their position. The coil springs 41 are connected, one to the other, by an endless chain. The connector 2 and its associated wire bundle are moved towards end 43, where the taped wires 1 may be removed.

SUMMARY OF THE INVENTION

It is an object of the invention then to design a wire processing apparatus which will take wires from a wire feed mechanism and move them to further processing stations, such as wire crimp stations, into electrical connectors.

In the preferred embodiment of the invention, then the cable making apparatus comprises a wire feed mechanism; two wire transfer tracks extending parallel to each other and transverse to the direction of the wire feed; shuttle means moveable along said track to move wires from the wire feed mechanism to positions distant from the wire feed mechanism; and connector housing feed mechanisms adjacent to the shuttle means to locate the connector housings proximate to the wire ends.

In the preferred embodiment of the invention, the shuttle means comprise shuttle housings having wire locating means disposed on an open upper face thereof, and means to retain the wires in the shuttle housings.

In the preferred embodiment of the invention, the wire feed mechanism feeds the wires over the shuttle housings to leave a discrete length of wire extending beyond the shuttle housing.

In the preferred embodiment of the invention, the connector housing feed mechanism is positioned out board of, and parallel to, the wire transfer tracks.

In a second aspect of the invention a wire transfer station comprises an upper wire transfer track having wire shuttle means disposed thereon and moveable relative thereto, a lower wire transfer track having wire shuttle means disposed thereon and moveable relative thereto, a forward elevator mechanism which is moveable from the lower wire transfer track to the upper wire transfer track, a rearward elevator mechanism which is moveable from the upper wire transfer track to the lower transfer track, first pusher means adjacent to the forward elevator mechanism and the upper wire transfer track, for moving the wire shuttle means towards the rearward elevator member, and second pusher means adjacent to the rearward elevator mechanism and the lower wire transfer track, for moving the wire shuttle means towards the forward elevator member.

BRIEF DESCRIPTION OF THE DRAWINGS

The preferred embodiment of the invention will now be described by way of reference to the following figures, where:

FIG. 12 is a diagrammatical view showing the shuttle mechanisms moving into a shuttling position;

FIG. 13 is a diagrammatical view showing the comb members out of position with the individual wires being severed;

DETAILED DESCRIPTION OF THE INVENTION

Figure 1:
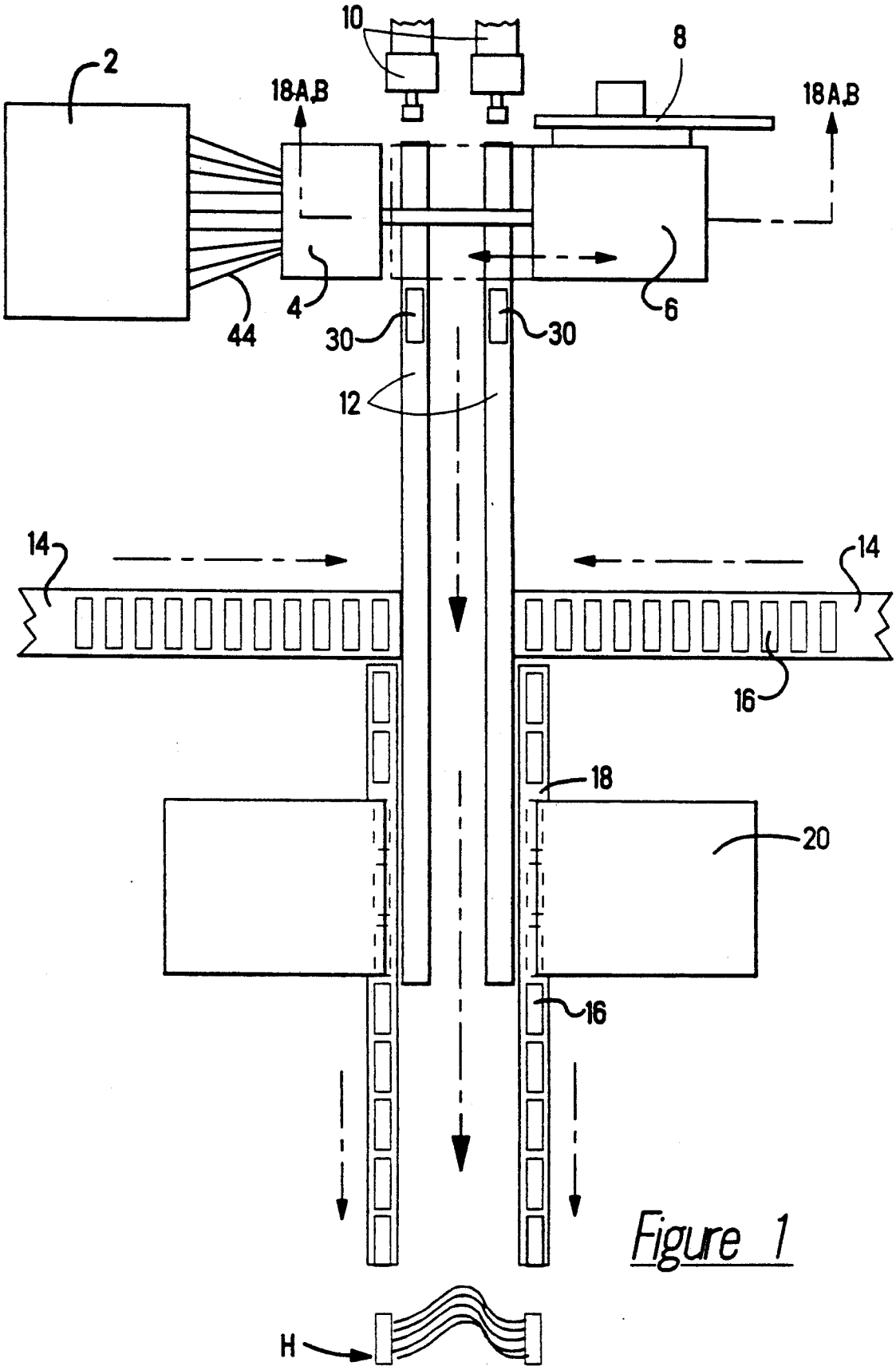
FIG. 1 is a diagrammatical view of the lead making machine of the instant invention.

Reference will now be made to FIGS. 1-17, where the functioning of the machine will be made with reference to the diagrammatical views, and then the wire gripping and pitch setting devices will be described in greater detail with reference to FIGS. 18-26. With respect first to FIG. 1, the harness making machine includes a wire supply 2 having a plurality of reels of insulated conductors of various size and insulation type, which supplies a wire feed mechanism shown generally as 4. A wire gripping device shown generally as 6 is moveable from a position proximate the wire feed mechanism 4 as shown in phantom in FIG. 1 to the right, to a position aligned with the pitch setting mechanism 8, also as shown in FIG. 1.

Two transfer mechanisms 12 are shown which extend perpendicular to the direction of movement of the wire gripping mechanism 6. FIG. 1 also shows wire shuttling devices 30 which are located on the two transfer mechanisms which shuttle the complete set of conductors for a harness to further processing stations. To that end, two push rods 10 are shown behind the two transfer members 12 and aligned therewith, the push rods having the capability of pushing the individual shuttle members down the transfer mechanism 12. Two connector feed mechanisms 14 are shown on the outside of each of the track members 12 which feed empty connector housings toward the track members into connector transport mechanisms 18. The transport mechanisms 18 feed the empty connector housings into the crimping stations 20 whereby the wires are crimped into the connector housings and then discharged as finished harnesses H, as shown in FIG. 1.

Figure 2:
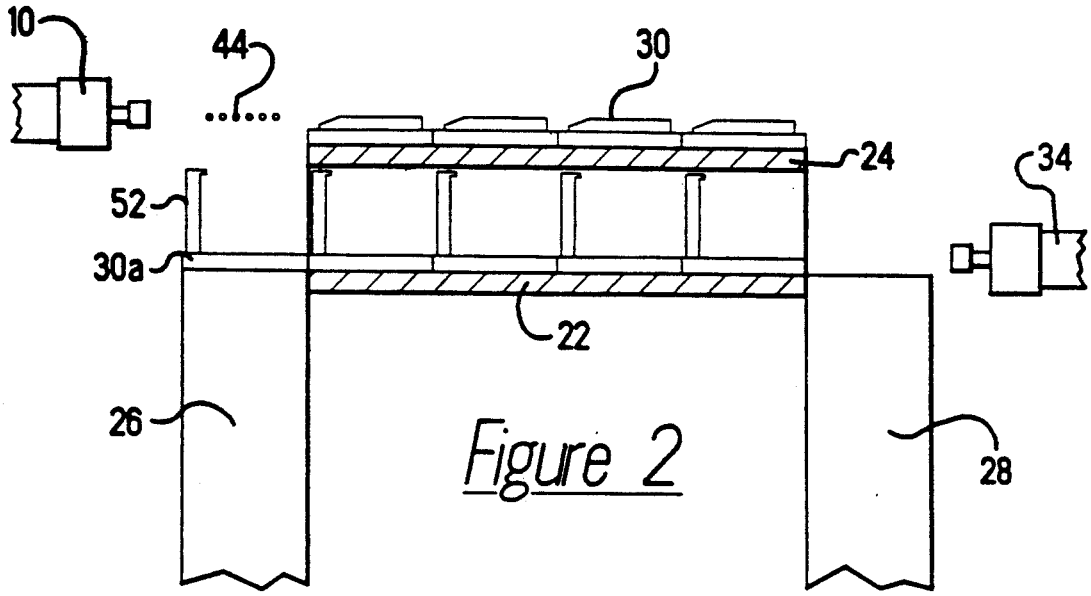
FIGS. 2–7 are diagrammatical views of the shuttle mechanism showing the lateral movement of the wire bundle into juxtaposition with the crimping mechanism.
Figure 3:
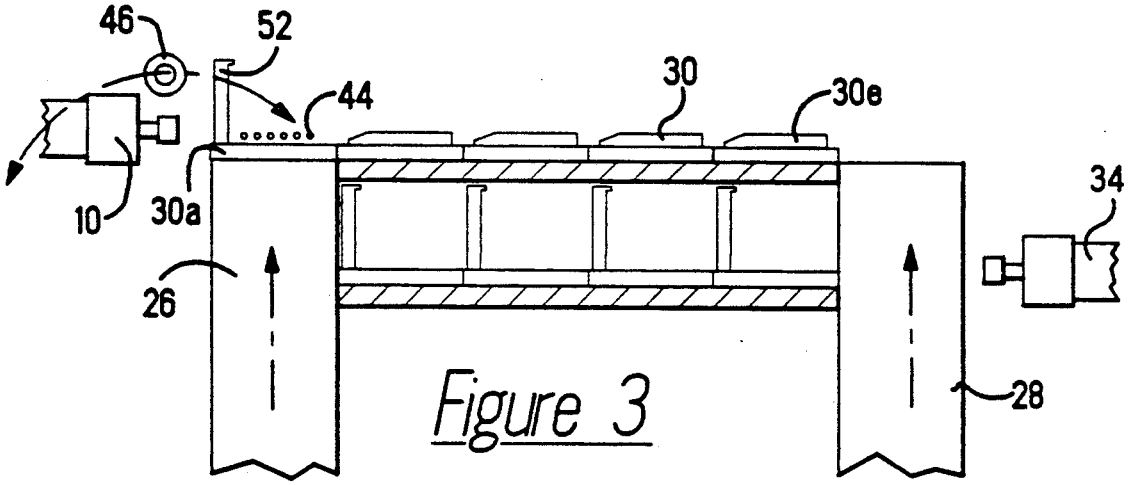
Figure 4:
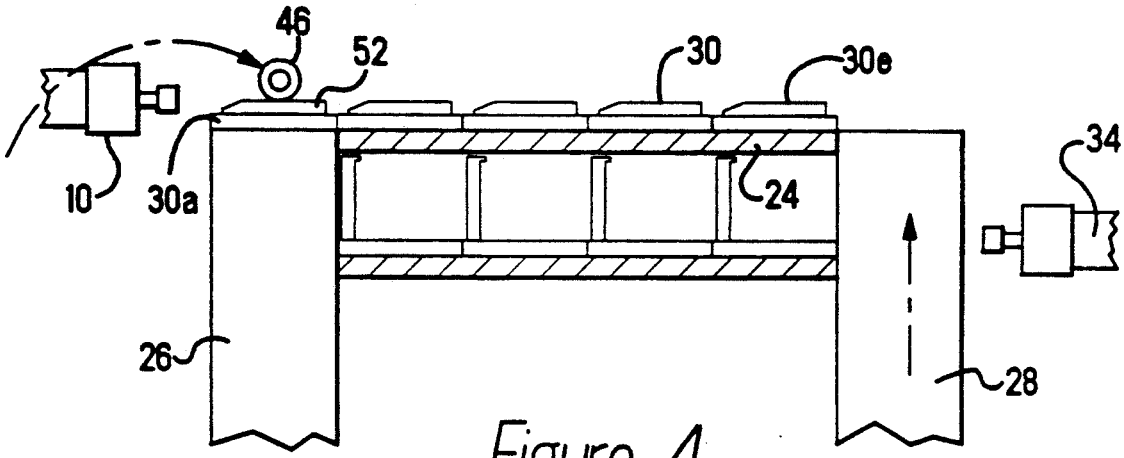

With reference now to FIG. 2-4, the shuttle mechanisms 12 as shown in FIG. 1, are shown diagrammatically in side plan view as generally including a lower track 22 and an upper track 24, where a plurality of individual shuttle members 30 are moveable longitudinally along the upper and lower track members 24, 22 respectively. The wire transfer mechanism 12 also includes a first elevator member 26 adjacent to the push rod 10 and a second elevator member 28 adjacent to the push rod 34.

Figure 8:
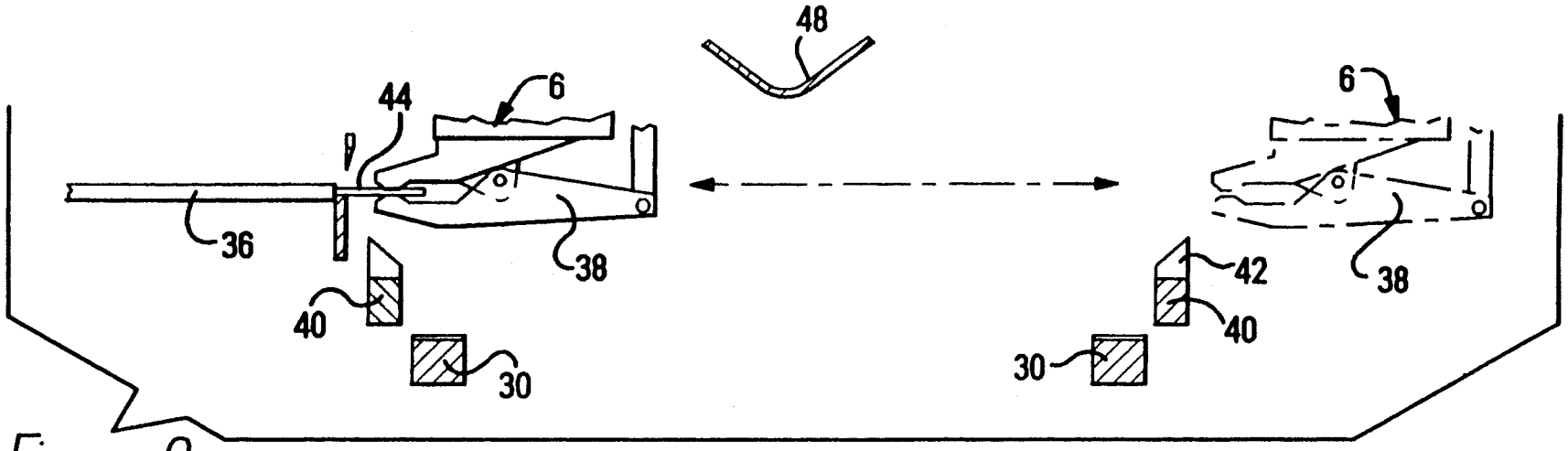
FIG. 8 is a diagrammatical view showing the wire gripping mechanism in its initial position.

With reference to FIG. 8, the individual gripper members 38 are shown disposed above both of the shuttle members 30. Adjacent to each of the shuttle members 30 is a comb member 40 having individual plates or teeth 42, with each of the plates 42 being dimensioned to fit between spaced apart wires 44, the comb members being moveable towards the center of the machine to "comb" or straighten the wires 44. A wire lengthening member 48 is disposed above the wires 44 and will be discussed more fully herein. With a complete synchronization of the wire gripping mechanism 6, the elevator members 26, 28 and the push rods 10 and 34, the shuttle members 30 can be moved in a continuous cycle or loop thereby moving the wire bundles from the wire feed mechanism 4 to the wire crimping station 20, as explained below.

The cycle begins at the positions shown in FIGS. 2 and 8. With respect to FIG. 2, the first elevator member 26 is shown in the lower position where the upper surface of the first elevator 26 is aligned with the lower track 22. The first shuttle member 30*a* is shown disposed on the upper surface of the first elevator member 26 where the upper cover 52 of the first shuttle member 30*a* is in the open position. With the shuttles 30*a* in the lower position as shown in FIG. 2, the wire gripping mechanism 6 moves to the position adjacent to the wire feed mechanism 4 such that individual gripper members 38 grip individual wires 44, as shown in FIG. 8. With the individual wires gripped by the wire gripper members 38, the gripping mechanism 6 can be moved to the right to the phantom position shown in FIG. 8 such that the individual wires 44 span both of the open shuttle members 30 as shown in FIG. 9.

Figure 9:
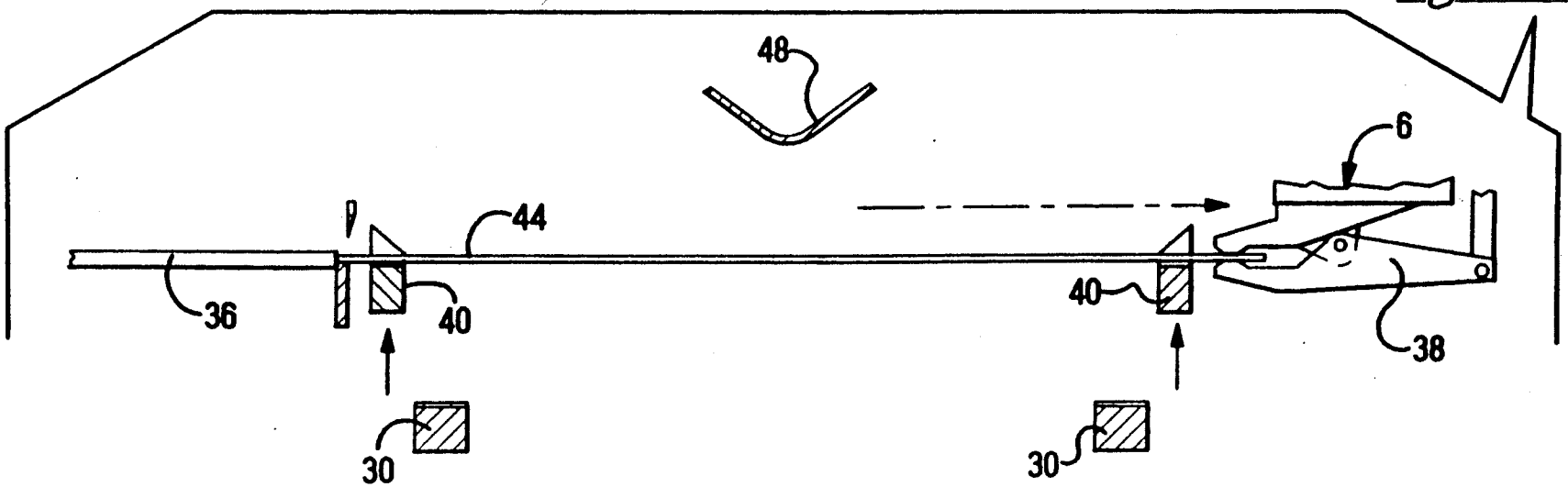
FIG. 9 is a diagrammatical view similar to that of FIG. 8 showing the wire gripping mechanism having pulled the wire such that the wire spans the shuttle tracks.
Figure 10:
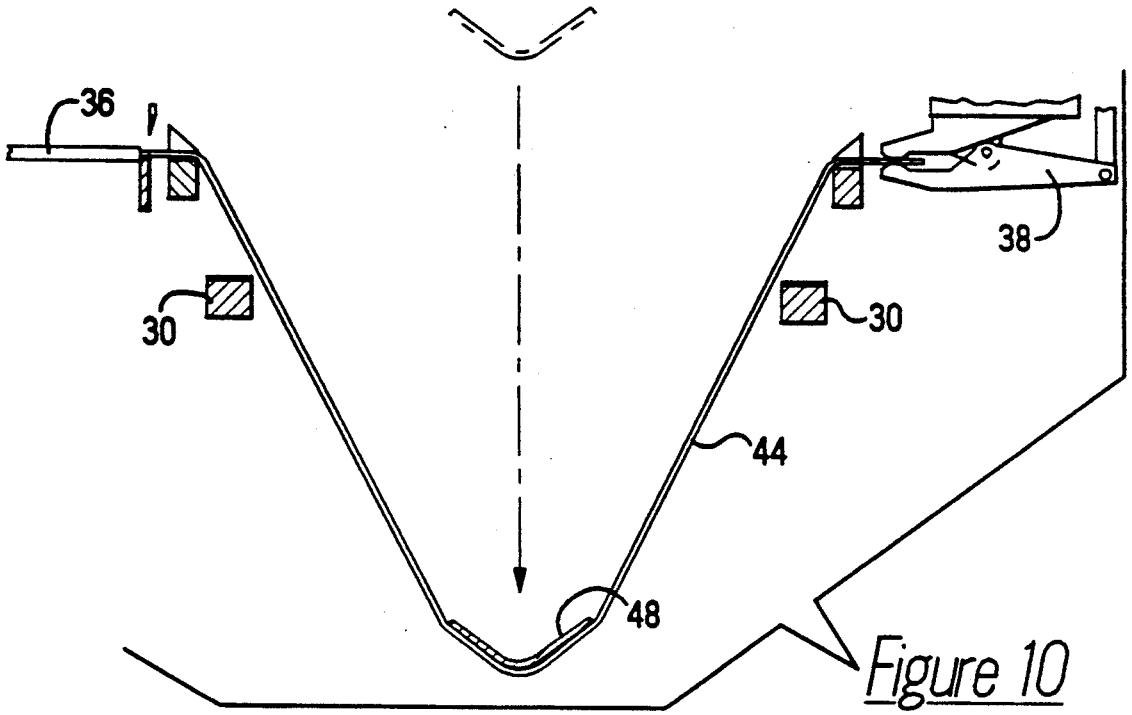
FIG. 10 is a diagrammatical view similar to that of FIG. 9 showing the individual wires lengthened to their predetermined harness length.

After the wire gripping mechanism 6 has moved to the position shown in FIG. 9, the individual wire gripping members 38 can be spread apart laterally to set the side-to-side spacing between the conductors 44 at the gripper members. The two comb members 40 then move upwardly to the position shown in FIG. 9 where the individual teeth are interweaved between adjacent individual wires 44. The spacing between the wire ends at the feed tube and at the grippers, may be different, due to the spreading of the wire grippers 38, however the combs preserve that spacing. The combs are designed with a given pitch between their plates 42, and can therefore accommodate different pitches at the opposite ends. As shown in FIG. 10, the wire lengthening mechanism 48 is now moved vertically downwardly to feed more length of the individual wires out of the feed tubes 36 such that the overall length of the individual wires 44 corresponds to the length of the harness desired.

Figure 11:
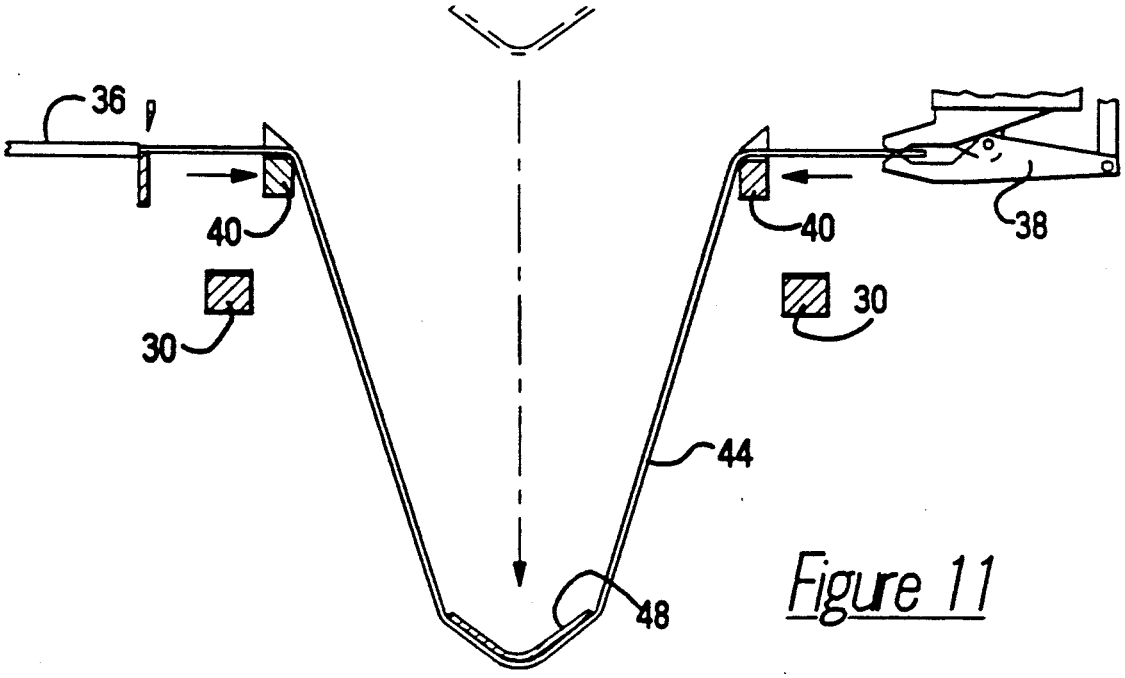
FIG. 11 is a diagrammatical view showing the comb members moving inwardly to align the individual wires with the shuttle mechanisms.
Figure 14:
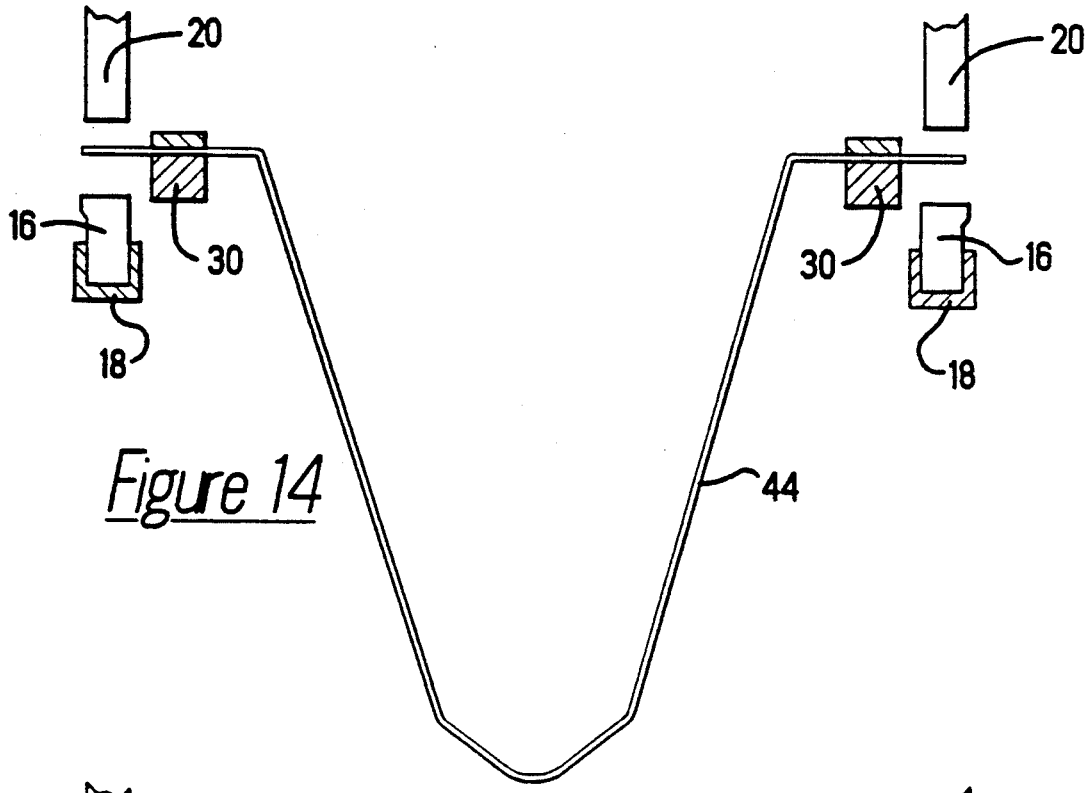
FIG. 14 is a diagrammatical view showing the shuttle mechanisms positioning the individual wires over two connector housings and in juxtaposition with a crimping mechanism.

As shown in FIG. 11, the comb members 40 are now moved towards the central axis and inwardly of the two open shuttle members 30. This combing action assures that the wires across the shuttles are even, and not, for example twisted. As shown in FIG. 12, the wire lengthening mechanism 48 now moves vertically away from the wire and the shuttle members 30 move upwardly to move adjacent to the free ends of the individual wires 44 to retain them. The upward movement of the shuttle members 30 shown in FIG. 12 corresponds to the upward movement of the first elevator members 26 as shown in FIG. 3, which places the individual wires 44 adjacent to the shuttle member 30*a*. The actuator 46 may now be moved from the position shown in FIG. 3 to the position in FIG. 4 which closes the upper cover 52 of the individual shuttle member 30*a* which retains the individual wires 44 in the desired spread configuration. As shown in FIG. 13, a knife member 70 severs the end of the wire 44 adjacent to the wire feed mechanism 2 to define a discrete length of wire for the harness.

Figure 5:
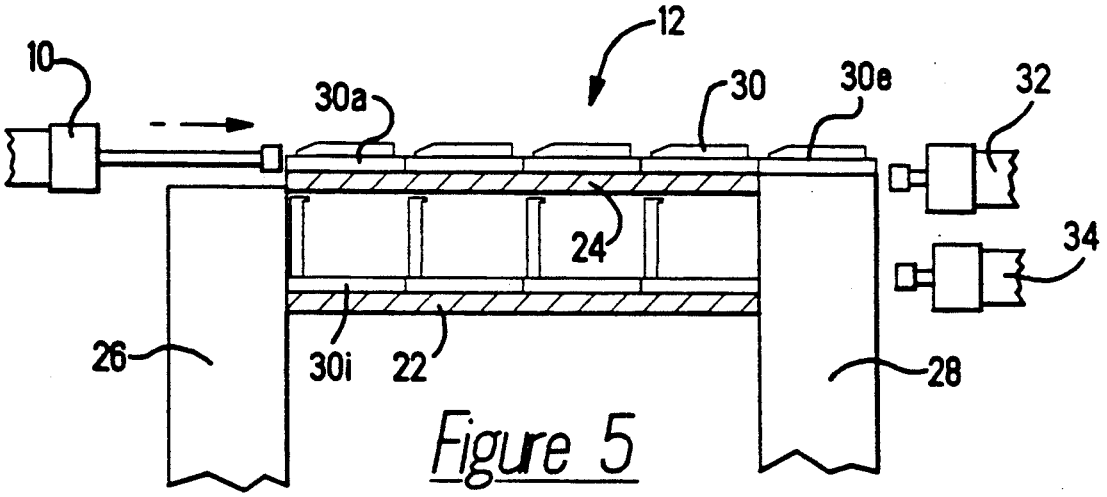

With the knife member 70 in the upward position and the comb members 40 in the retracted position, both of which are shown in FIG. 13, the individual shuttle members 30 are now ready for movement to their next position. With reference to FIG. 5, the push rod 10 is now actuated which pushes the individual shuttle member 30*a* from the position on top of the first elevator 26 to a position on the upper track member 24. It should be noted that the second elevator member 28 is also disposed in its upward position as shown in FIG. 5 with its upper surface aligned with the upper surface of the track 24, such that when the individual shuttle member 30*a* is pushed from the elevator 26 to the track member 24, another individual shuttle member 30*e* moves from the position shown in FIG. 4 at the end of the track 25 to the position shown in FIG. 5 on the upper surface of the second elevator member 28. When the individual shuttle member 30*e* is in the position shown in FIG. 5, the individual shuttle is in the position shown in phantom in FIG. 15, where the free ends of the wires are aligned above two connector housings 16, one at each end.

Figure 6:
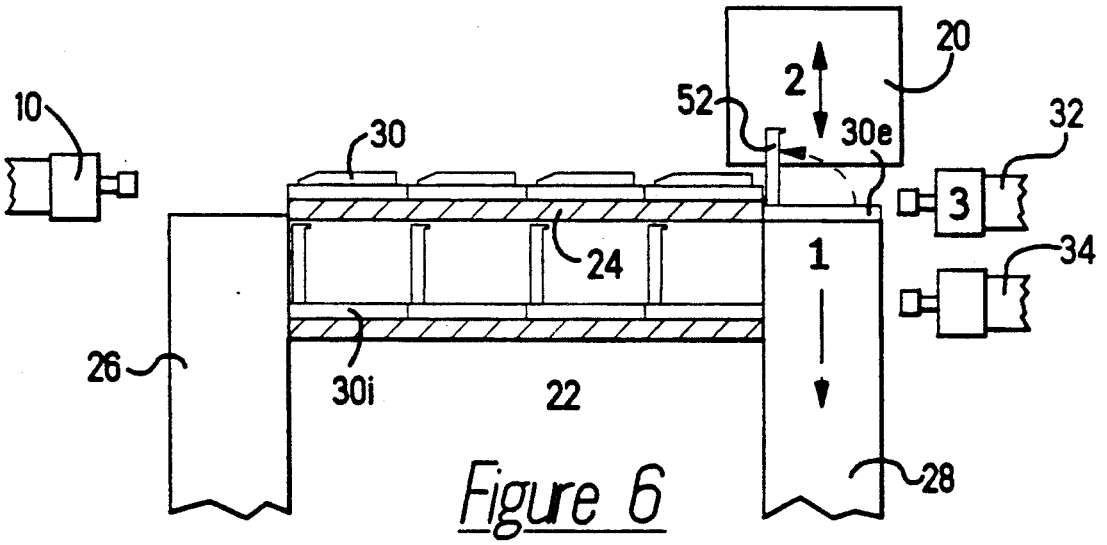
Figure 15:
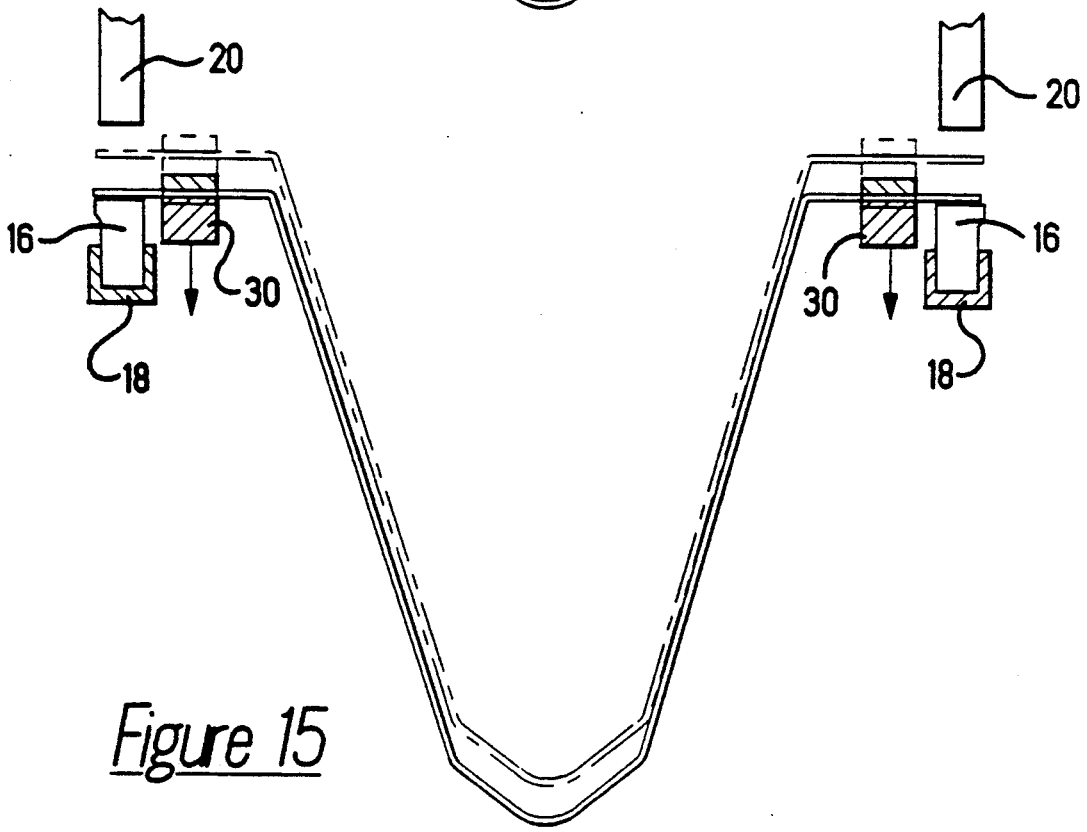
FIG. 15 is a diagrammatical view showing the individual shuttles moving from an upward (shown in phantom) position to a position where the ends of the wires are aligned with the connectors.
Figure 16:
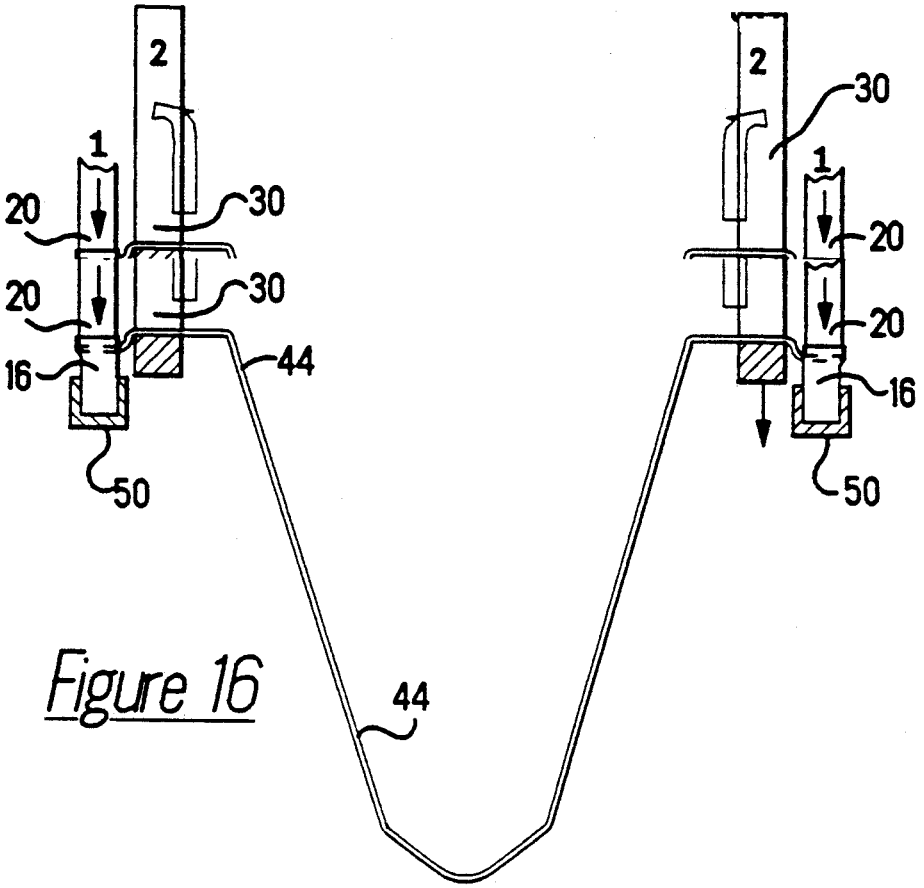
FIG. 16 is a diagrammatical view showing the crimping mechanisms terminating in the individual wires with selected terminals in the connector housings.
Figure 17:
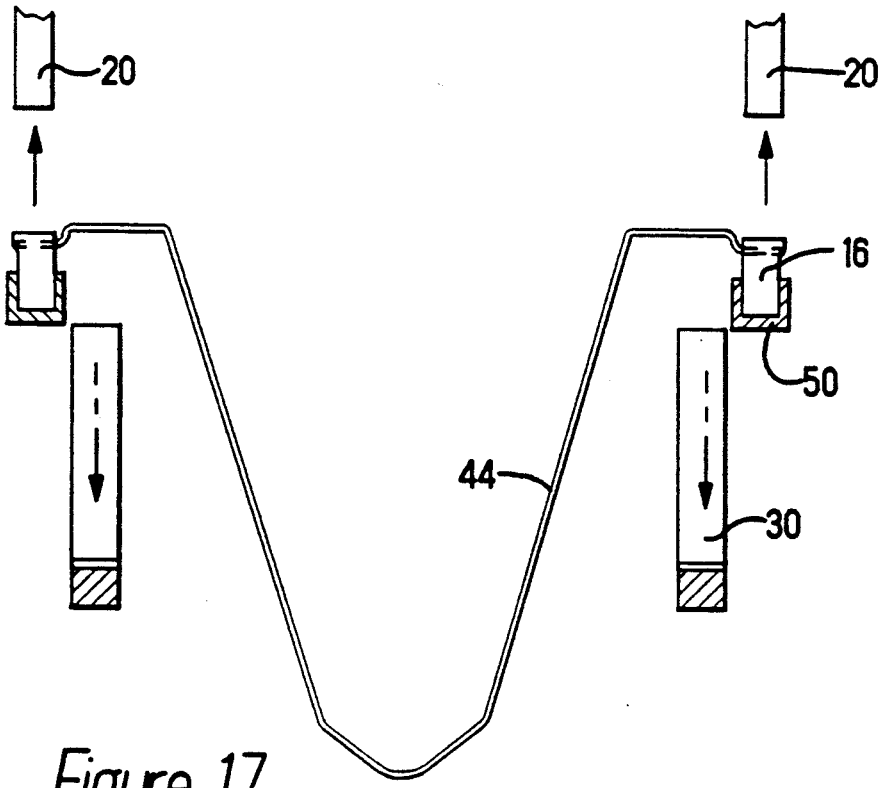
FIG. 17 is a diagrammatical view showing the lowering of the shuttle members out from under the individual wires of the completed wire harness.

With the free ends of the wires vertically aligned with the connector housings, the second elevator member 28 is now moved down slightly from the position shown in FIG. 5 to the position shown in FIG. 6, which moves the free ends of the individual wires 44 from the position shown in phantom in FIG. 15, to the end position shown in FIG. 15, where the individual free ends of the wires 44 are now in disposition directly above insulation displacement portions of the terminals found in the connector housings 16. As shown in FIG. 16, the crimping apparatus 20 is now activated which moves the free ends of the individual wires 44 into electrical connection with the insulation displacement portions found in the terminals of connectors 16. As shown in FIG. 6, after the termination of the wires to the respective terminals, the actuator 32 is now activated which opens the upper cover 52 of the individual shuttle member 30*e*, which frees the wires. Since the wires are now mechanically and electrically connected to the connector housings 30 at the opposite ends of the wires 44, the connector harness H is now free to move down the tracks 18, without dependence on the shuttle mechanisms 30. The transport mechanism 18 now feeds another set of empty connector housings 16 onto the mechanisms 18 which pushes the completed harness further down the tracks 18. This movement of the harness, moves the wires from a position above the shuttles 30*a* to a position further down the tracks 18.

Figure 7:
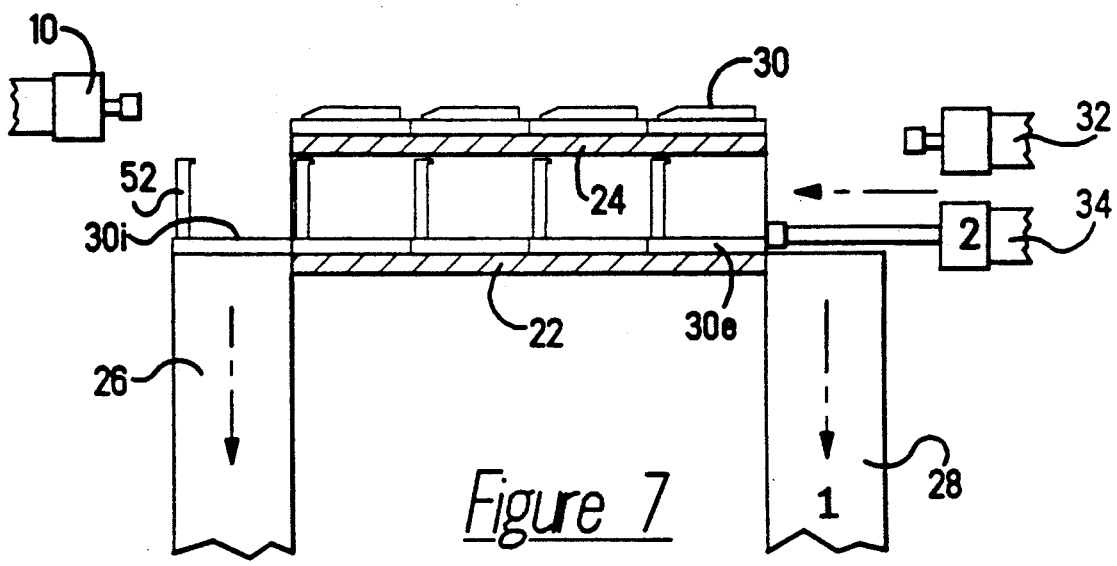

The first elevator 26 and the second elevator member 28 are now moved from the positions shown in FIG. 6 to the positions shown in FIG. 7 where their upper surfaces are aligned with the upper surfaces of the lower track member 22. The push rod 34 is now activated which moves individual shuttle member 30*e* from the position on top of the elevator member 28 to the position shown in FIG. 7 on the lower track member 22. Conveniently, the movement of the individual shuttle member 30*e* on to the track 22 also pushes the last individual shuttle member 30*i* from the lower track 22 onto the upper surface of the first elevator member 26. It should be noted that the position of the individual shuttle member 30*i* as shown in FIG. 7 is the same as the position of individual shuttle member 30*a*, as shown in FIG. 2 and is now ready for a new cycle.

DETAILED DESCRIPTION OF THE WIRE GRIPPING MECHANISM

Figure 18A:
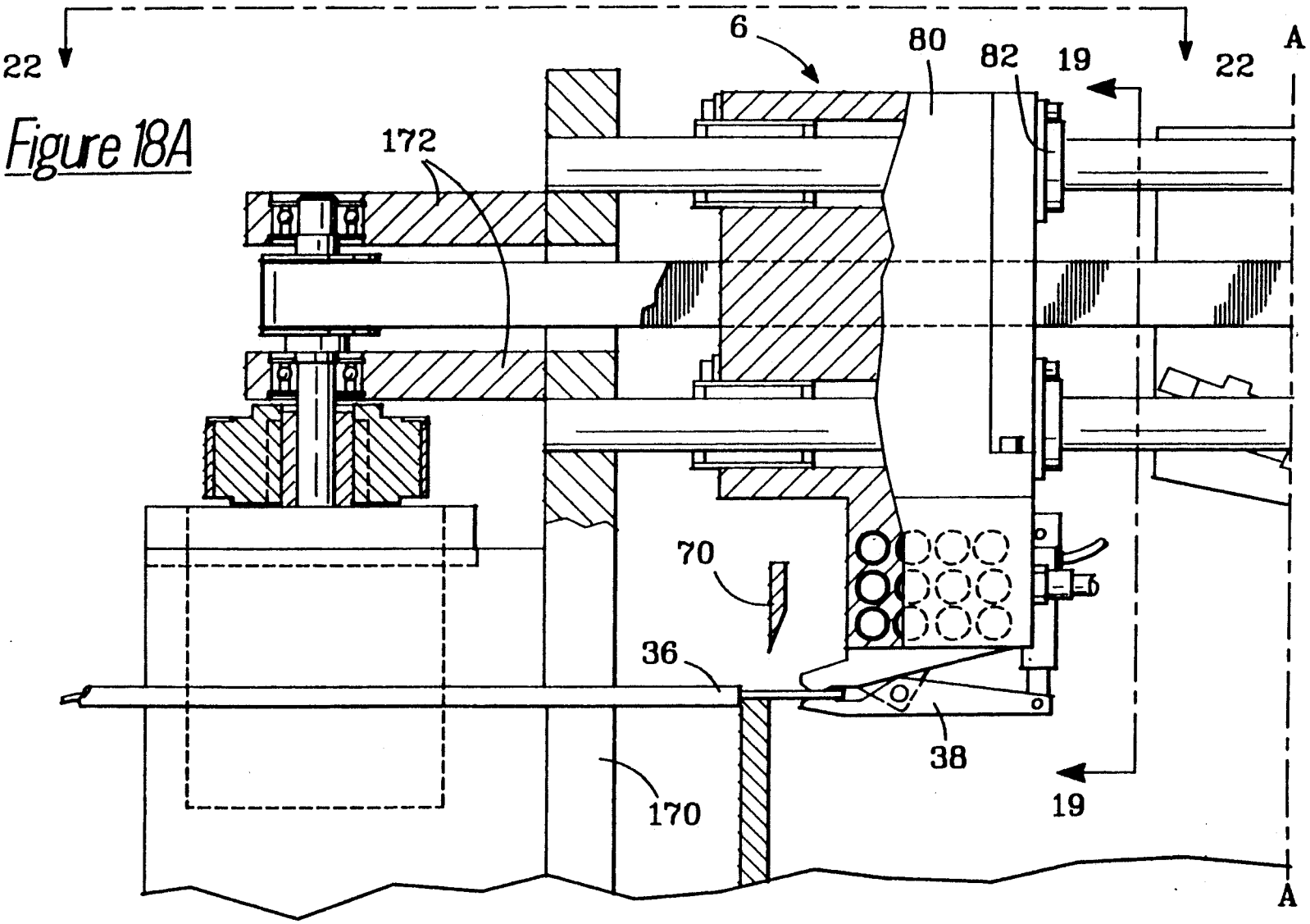
FIGS. 18A and 18B are partial cross-sectional views of the wire gripping apparatus through lines 18A,B-1-8A,B of FIG. 1.
Figure 18B:
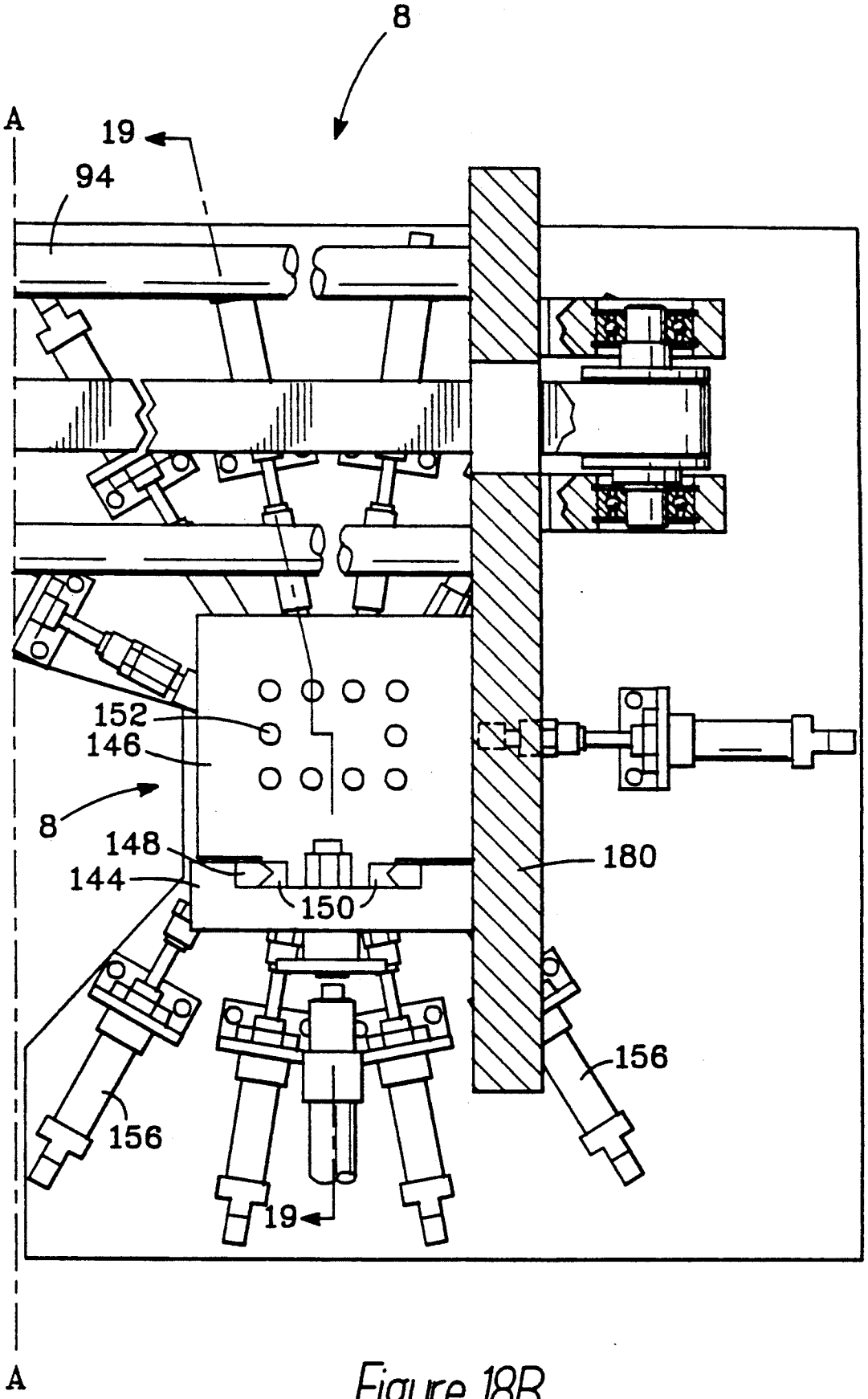
Figure 22:
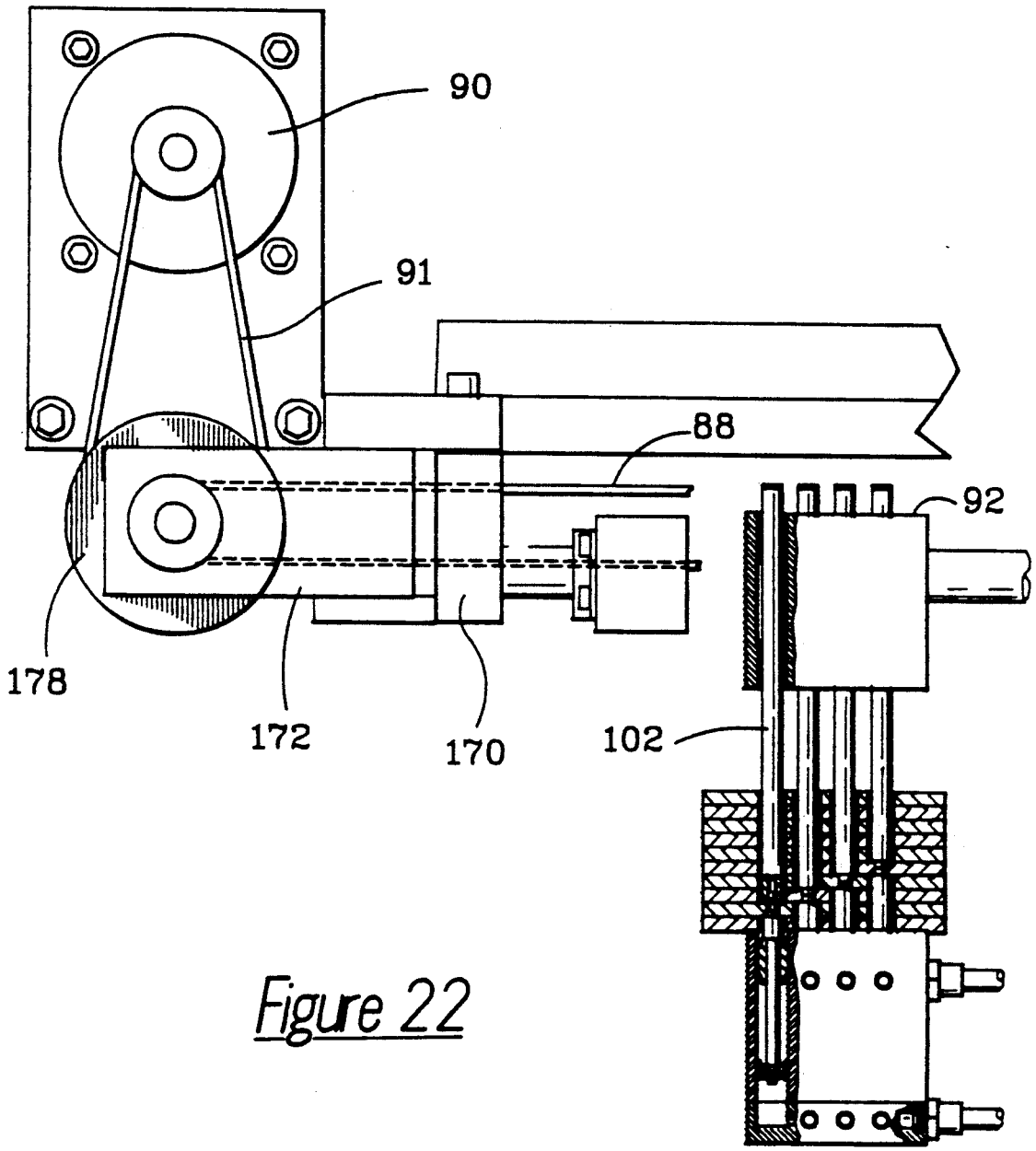
FIG. 22 is a view along lines 22—22 of FIG. A, partially in cross-section.

With respect now to FIGS. 18A and 18B, the wire gripping mechanism 6 and the pitch setting mechanism 8 are shown in greater detail. The assembly first comprises support beams 170 and 180 which upstand from a structural member such as a table top (not shown) and are fixed relative thereto. The structural beam 170 includes bearing support members 172 securely fastened to the structural beam and houses two bearings 174 therein. A drive gear 84 is suspended between the two bearings 174 and has an output shaft 176 extending beyond the lower bearing 174. As shown in FIG. 22, a stepping motor 90 is included which drives a timing gear 178, via the timing belt 91. With respect again to FIG. 18A, drive gear 178 is interconnected to the drive shaft 176 thereby driving the timing belt 88. At the opposite end of the assembly, as shown in FIG. 18B, the structural beam 180 is also fixedly mounted to the support table and similarly includes bearing support members 182 fixed to the support beam thereby housing two bearings 184 and having a follower gear 86 mounted between the two bearings, supporting the drive belt 88.

Two guide rods 94 are supported by the support beams 170 and 180 which allow for the movement of the wire gripping mechanism 6. With respect still to FIG. 18A, the wire gripping device 6 generally comprises a housing member 80 having bearings 82 and 96 on each side thereof, the bearings being profiled to slidably guide the housing member 80 along the guide rods 94. It should be noted that the drive belt 88 is interconnected to the housing member 80 such that activation of the stepper motor 90 moves the housing member along the guide rods 94, between the two support members 170 and 180. As shown now in FIG. 21, the wire gripping device 6 is shown in side view. The housing member 80 generally includes on its lower side, portions 98 and 100 extending downwardly therefrom.

Figure 23:
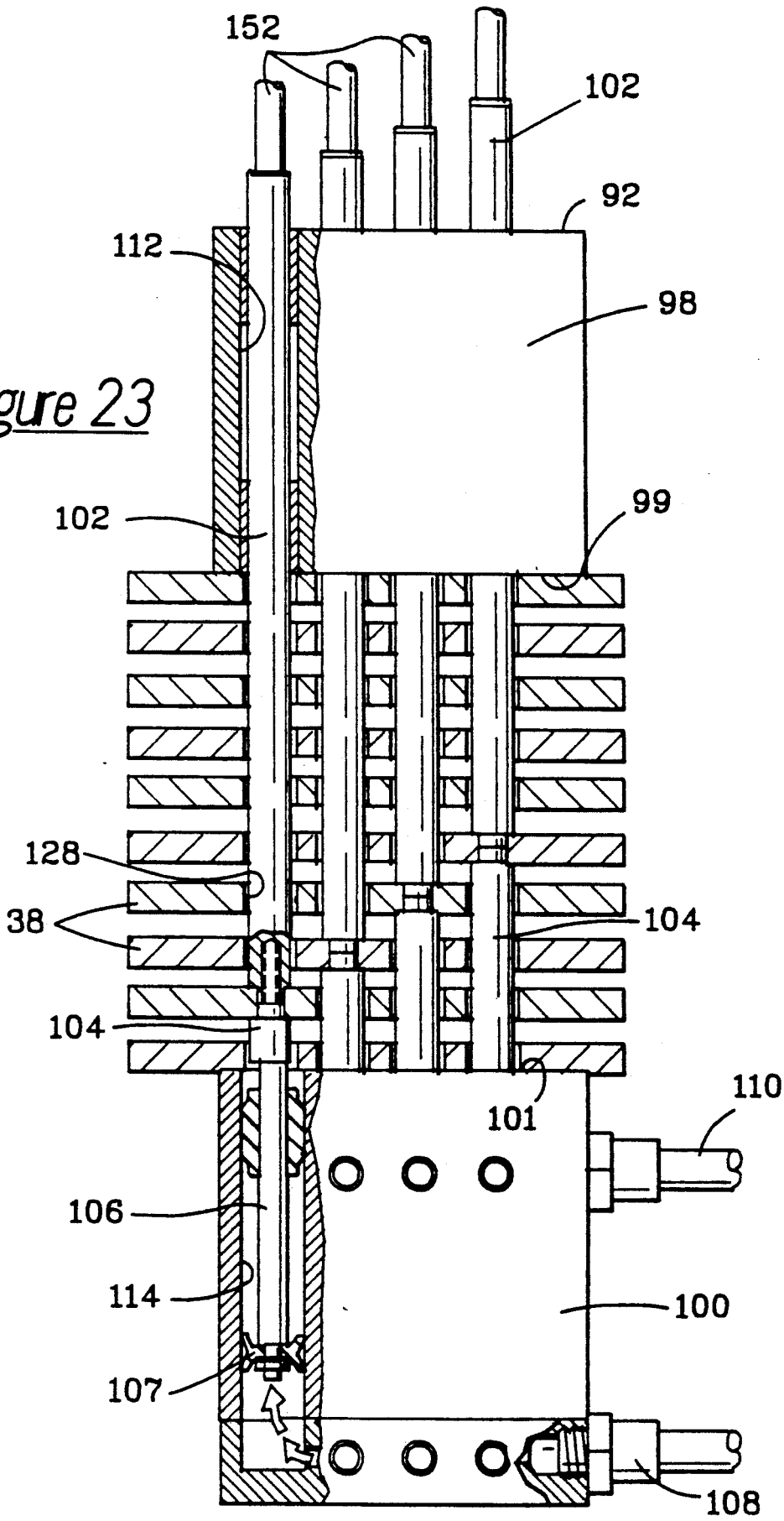
FIG. 23 is a cross-sectional view through lines 23—23 of FIG. 21.

With reference now to FIG. 23, the housing section 100 is shown in partial cross-section. The housing portion 100 actually houses a plurality of air cylinder pistons 106 which traverse within the internal bores 114. Each piston 106 is interconnected at its end with an extension portion 104. Each of the extension portions 104 includes a threaded fastener integral therewith which is complementary to a threaded end of one of the stop rods 102. It should be noted that the stop rods 102 are threadable onto the threaded fastener at the end of the extension portion 104 to trap between them one of the gripper members 38.

Figure 24:
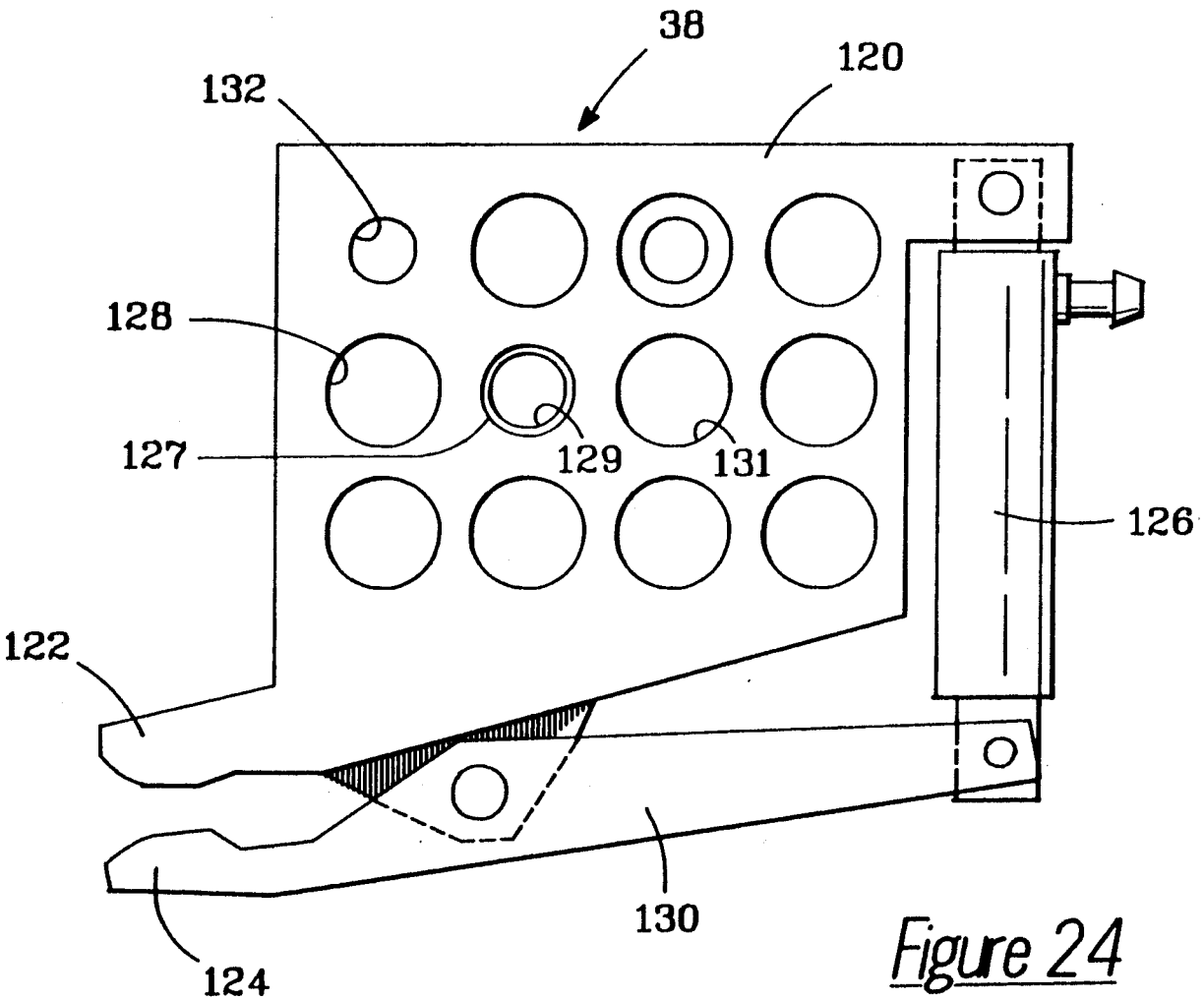
FIG. 24 shows a side plan view of an individual gripper member.
Figure 25:
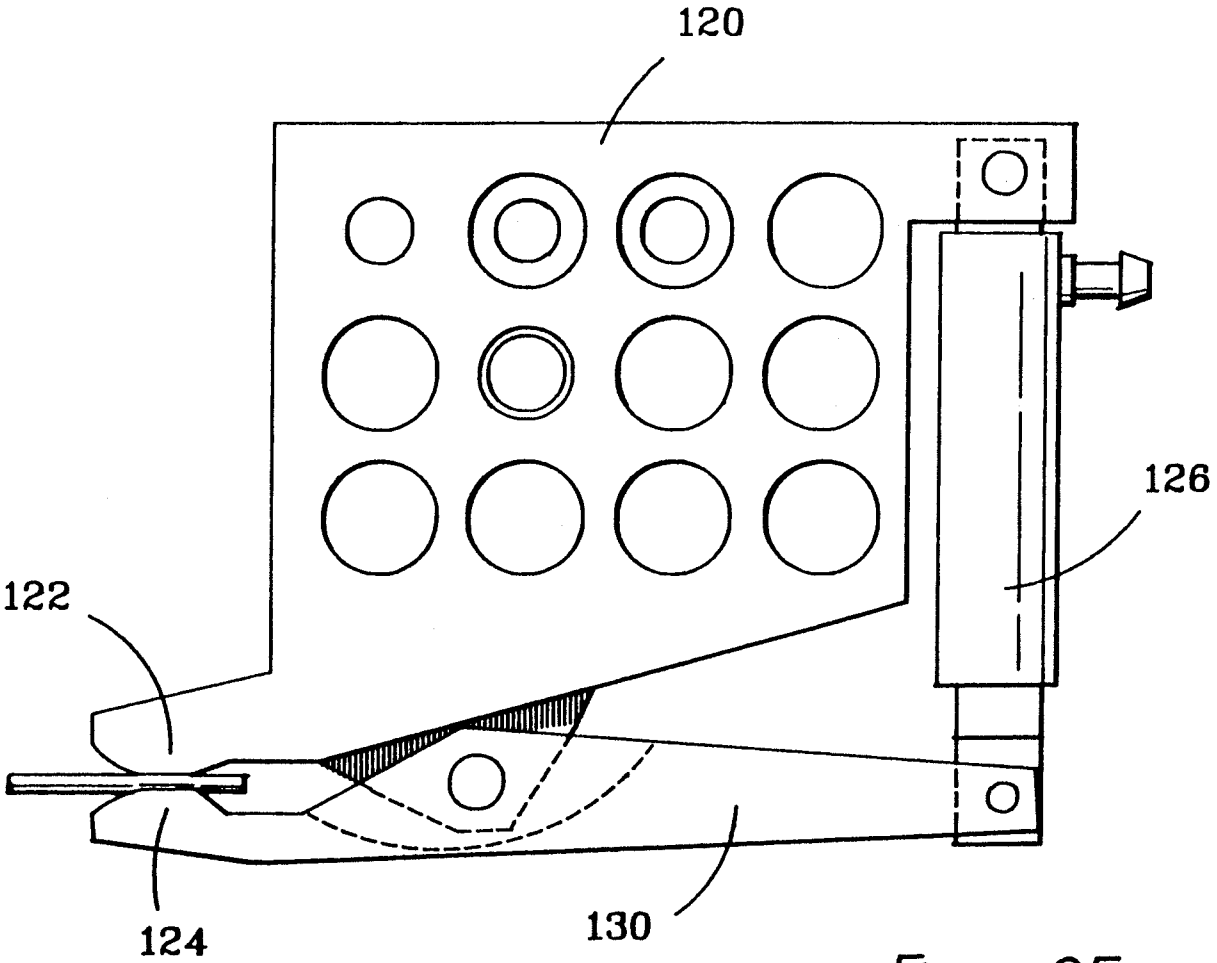
FIG. 25 shows a view similar to that of FIG. 24 showing the gripper member in an actuated condition.
Figure 26:
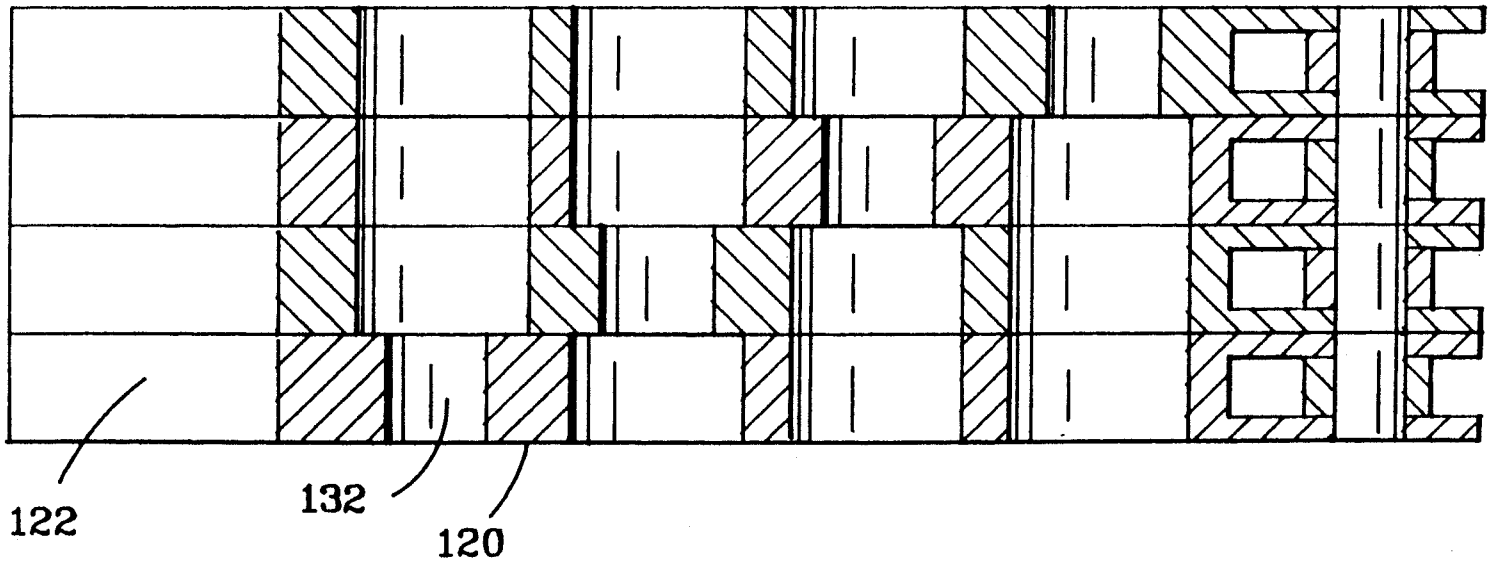
FIG. 26 shows a cross-sectional view through a plurality of gripper members.

With respect to FIG. 24, an individual gripper member is shown in greater detail where the gripper member includes a plate section 120 having through bores 128 and small bores 132, the through bore 120 being clearance holes for the passage of the stop rods therethrough. The plate portion further includes a bore 131 which allows for the passage of a cap screw to pass between the housing sections 98 and 100 in the direction of the stop rods. The plate portion 120 further comprises a center bore 127 having a bearing 129 therein. The gripper member 38 has a plate section 120 and a lower gripper arm 130 interconnected scissor fashion one to the other and actuated by an individual air cylinder 126. Extending from the front of the gripper member 38 are two gripper fingers 122 and 124. It should be noted from FIG. 23 that each air piston 106 is interconnected to only one stop rod 102 and also to only one gripper member 38. The interconnection between the pistons and stop rods 102 is made at the small bore 132 as shown in FIG. 23. This allows the air piston 106 to move only one gripper member 38 independently of all the other gripper members 38. Each of the plate members 120 has a through bore 127 which has a bearing 129 press fit therein and is profiled to receive therethrough another rod (not shown), which extends fixedly between the two housing portions 98 and 100.

With reference to FIG. 23, the air piston 106 has an air diaphragm 107 interconnected thereto, and the housing member 100 includes air passageways 108 and 110. It should be noted that air pressure to the passageway 108 will cause pressure on the back side of the diaphragm 107 thereby moving the air piston 106 upwardly as viewed in FIG. 23. Conversely, if the air piston 106 is desired to move downwardly, (as viewed in FIG. 23) air pressure in the passageway 110 exerts pressure on the inner side of the diaphragm 107 thereby moving the piston 106 and the representative gripper member 38 downwardly as view in FIG. 23. It should be noted that with respect to FIG. 21, the individual gripper members 38 are, by themselves, free to move between the stop surfaces 99 and 101, at any spaced apart increment.

With respect now to FIGS. 18B and 19, the pitch setting device 8 will be described in greater detail. With respect first to FIG. 19, the pitch setting device 8 includes a lower plate member 144 which is fixedly mounted relative to the table top, for example, to the structural beam 180 as shown in FIG. 18B. Mounted above the lower member 144, is an upper member 146 which is connected to the lower member 144 via a pair of complementary gibs 148 and 150 as best shown in FIG. 18B. The upper member 146 is movable relative to the lower member 144, from the position shown in FIG. 19 to the position shown in FIG. 20, via an air cylinder 145 interconnected to a pair of toggle links 147. The rear toggle link is fixed to the lower plate 144 at 147*a*, whereas the forward toggle link is fixed to the upper member at 147*b*.

The pitch setting device 8 further includes a plurality of stop pins 152 which are arranged in an array similar to the array of rods 102. The upper housing portion 146 includes inner bores 153 which receive the stop pins 152 in slidable relation therewith. A rear housing portion 162 is fixedly retained to the upper housing portion 146 and also includes a plurality of through bores 164 where each of the bores 164 are aligned with the bores 153 in the housing portion 146. A plate 140 as viewed in FIGS. 19 and 18B is fastened to the rear housing portion 162 and retains a plurality of individual air cylinders 156 thereto. The air cylinders 156 are mounted on the plate 140 in radial disposition relative to the inner bores 164, and each of the individual air cylinders 156 includes a moveable pin section 160 which is in communication with an individual bore 164 of the housing portion 162.

Figure 19:
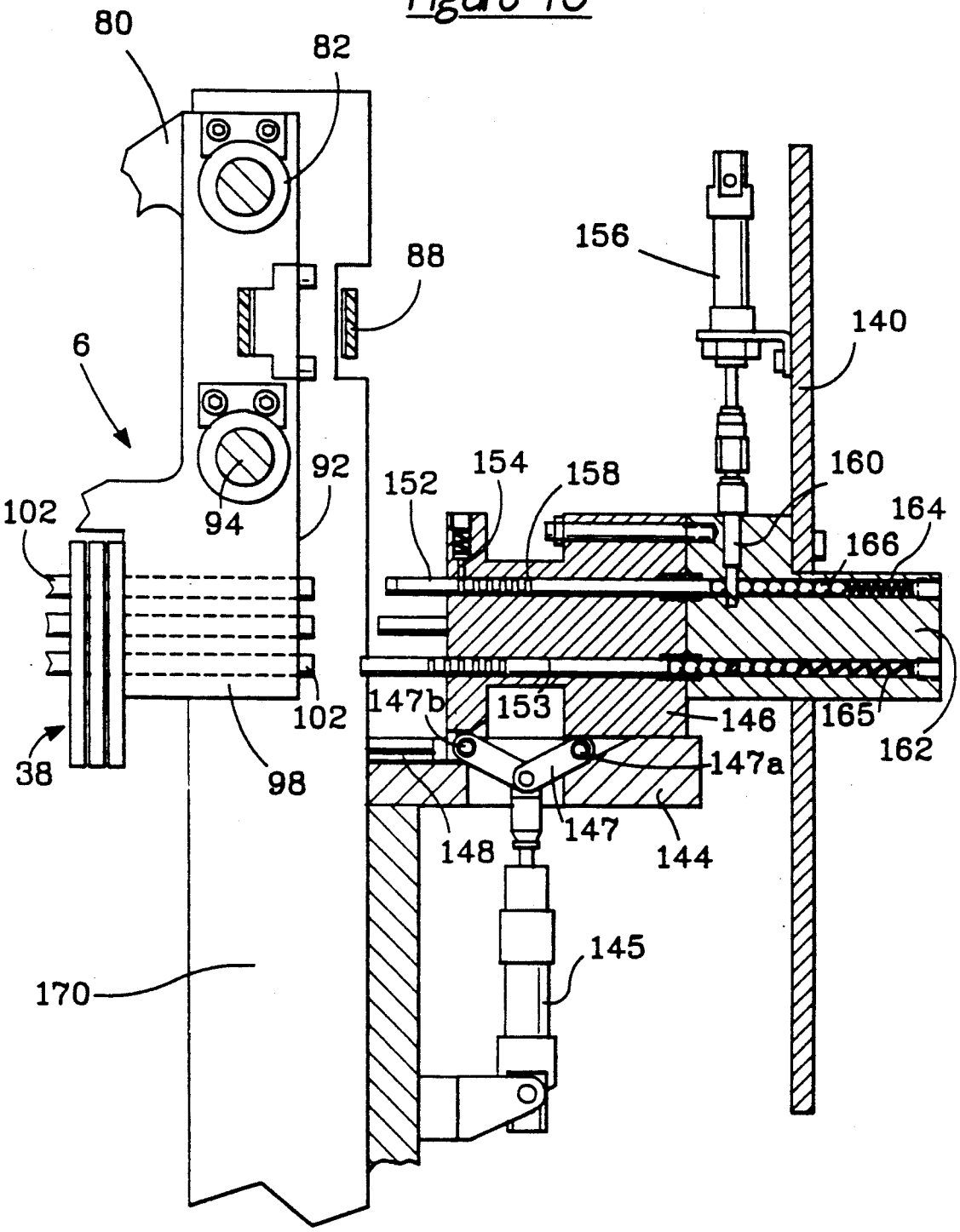
FIG. 19 is a cross-sectional view through lines 19—19 of FIG. 18A.

As shown in FIG. 19, each of the stop pins 152 includes intermediate its ends a plurality of detente grooves 158. The housing portion 146 includes a plurality of spring loaded pins 154 with one spring loaded pin 154 being radially aligned with one of the stop pins 152. The rear housing portion 162 includes a plurality of detente balls 166 located in the through bores 164, which are spring loaded forwardly by a spring member 165. It should be noted that the diameter of the detente balls 166 should correspond to the pitch between the terminals in the connectors being used in the harness, such that the addition of a ball causes the skipping of one terminal in the housing.

DETAILED DESCRIPTION OF THE SHUTTLE MECHANISM

Figure 27:
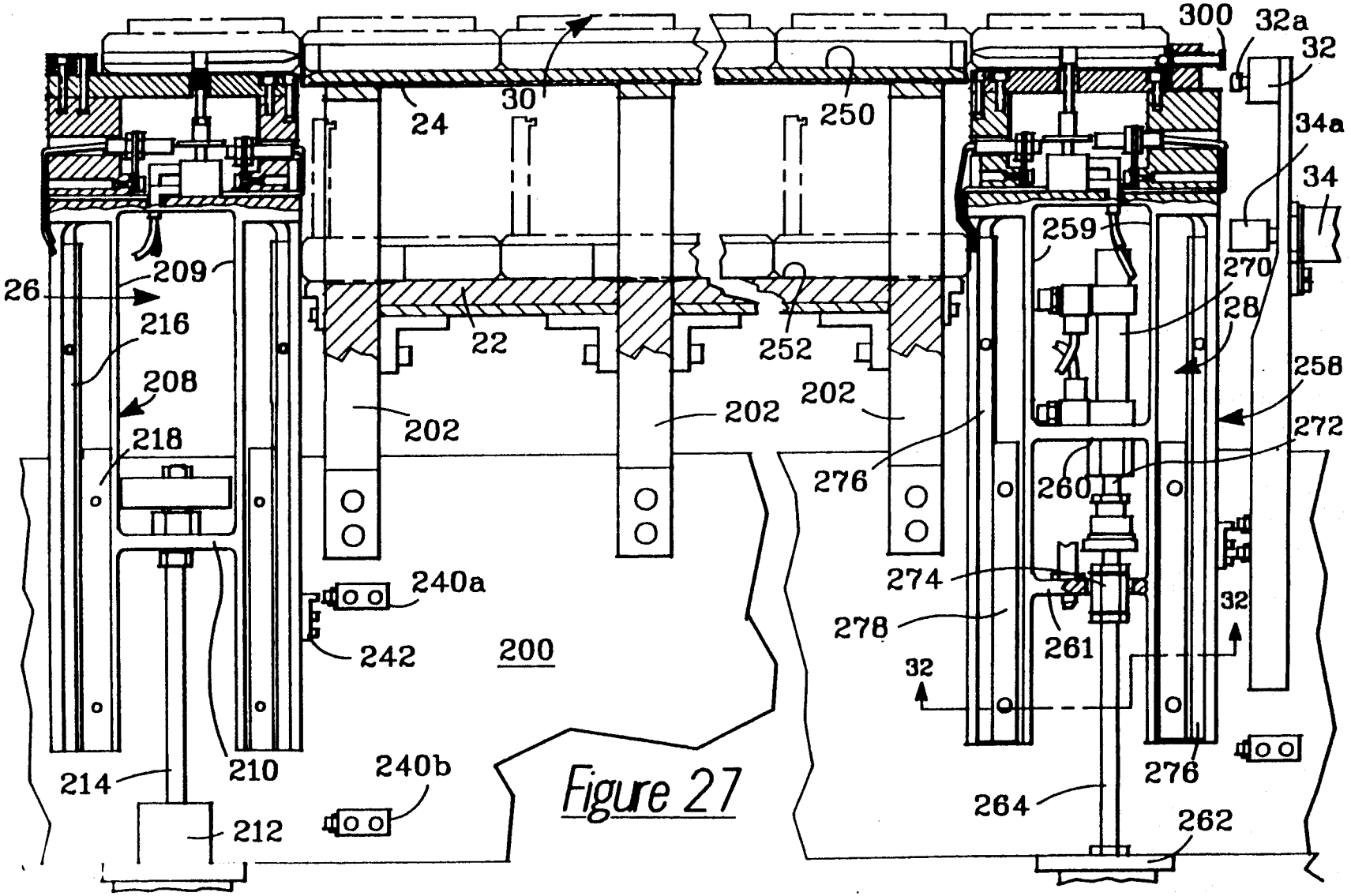
FIG. 27 is a side plan view of the shuttle mechanism.

With respect now to FIG. 27, the shuttle mechanism is shown as generally comprising a structural plate portion 200 having support brackets 202 extending vertically upwardly therefrom. Also supported by the structural plate 200 are the first elevator section 26 and the second elevator section 28. Intermediate the first and second elevator sections 26, 28 are the upper 24 and lower 22 channel sections which are supported by the brackets 202. The first elevator section 26 generally comprises an H-shaped frame 208 having vertical legs 209 and a horizontal cross bar 210. The vertical legs 209 have fixedly attached thereto gib sections 216, while mating gib sections 218 are fixedly attached to the structural plate member 200. An air cylinder 212 is fixedly attached to the structural plate member 200 and comprises a moveable rod 214 which is fixed to the horizontal cross bar section 210.

Figure 28:
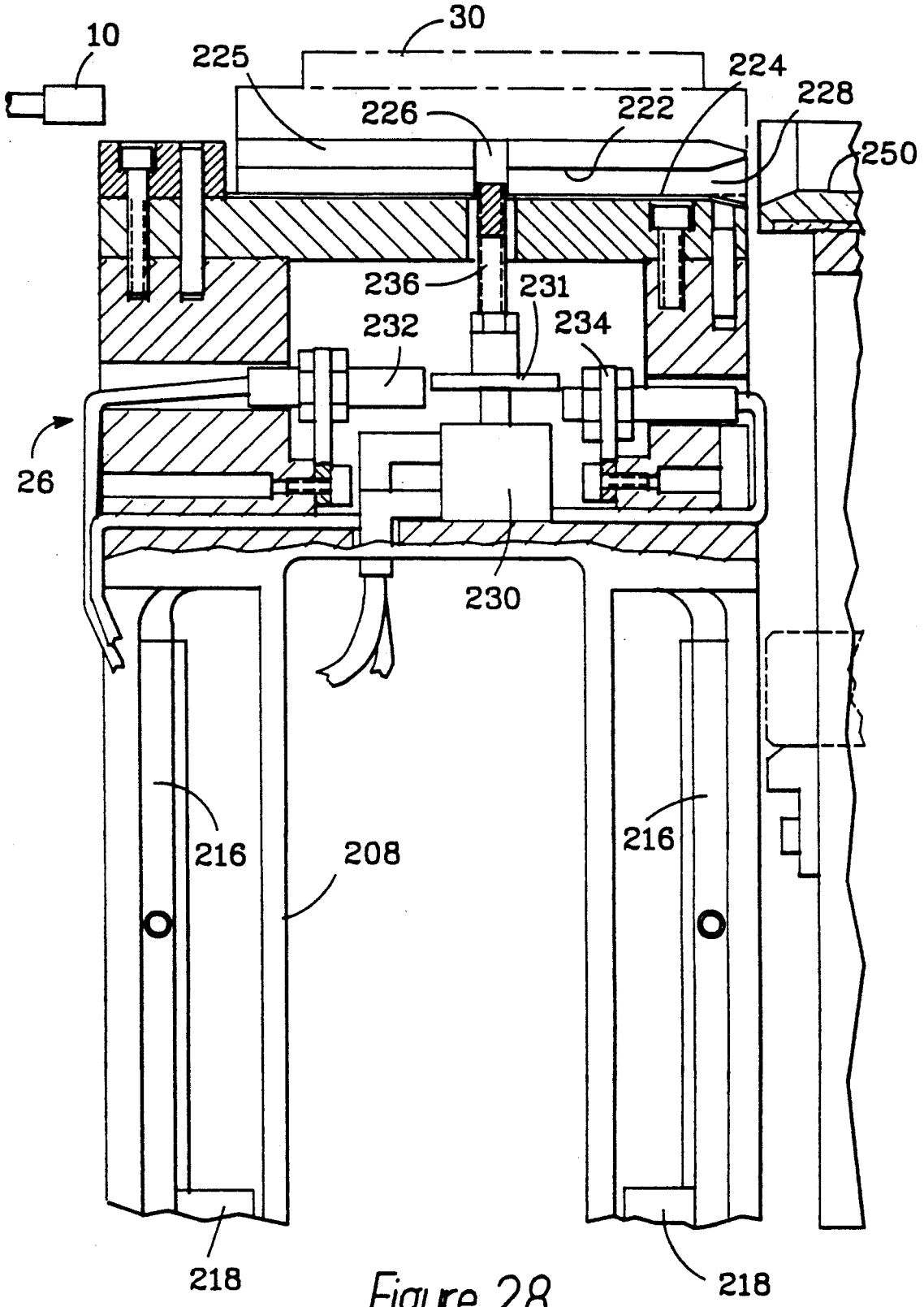
FIG. 28 is a detailed view of the upper half of the first elevator section.

With respect now to FIG. 28, the elevator section 26 includes an aligning mechanism for the shuttle member 30 (shown in phantom) comprising an air cylinder 230 and indicator plate 231 and a T-bar 236. Sensors 232 and 234 are fixed to the H shaped body section 208 and are set at different vertical heights. The upper portion of the elevator section 26 comprises an inwardly extending rib 225 which defines a slot 228 beneath the rib 225 having upper and lower surfaces 222 and 224. The upper elevator section 226 further comprises a transverse slot 226 profiled to allow movement of the T-bar section 236 upwardly and downwardly therein.

Figure 32:
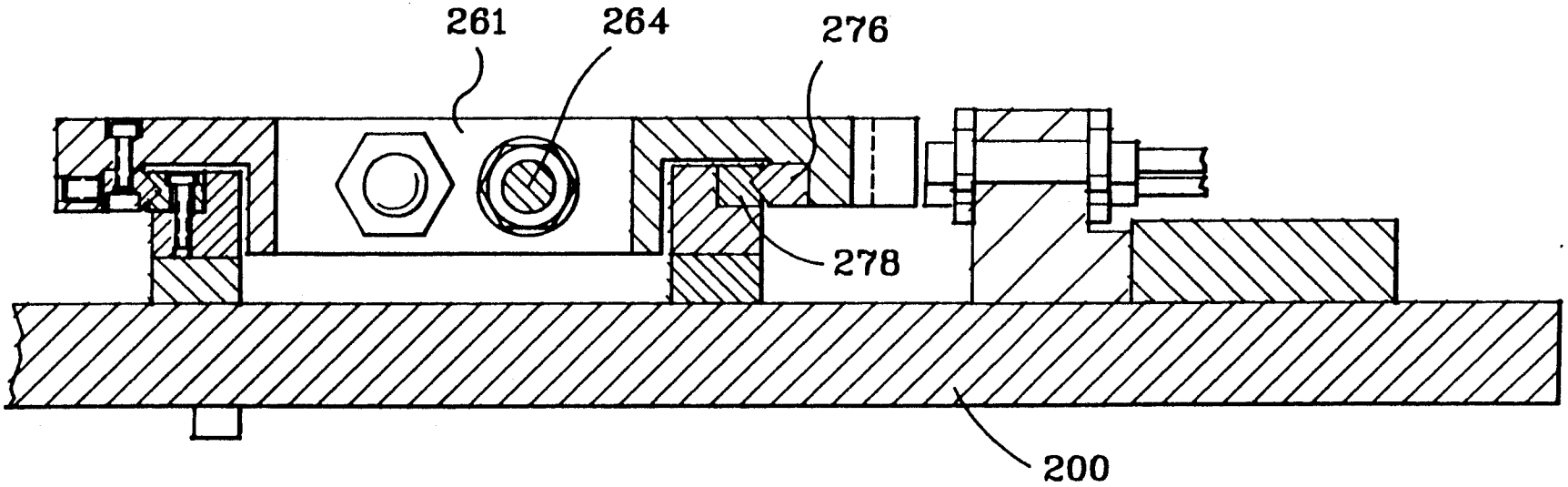
FIG. 32 is a cross-sectional view through lines 32—32 of FIG. 27.
Figure 33:
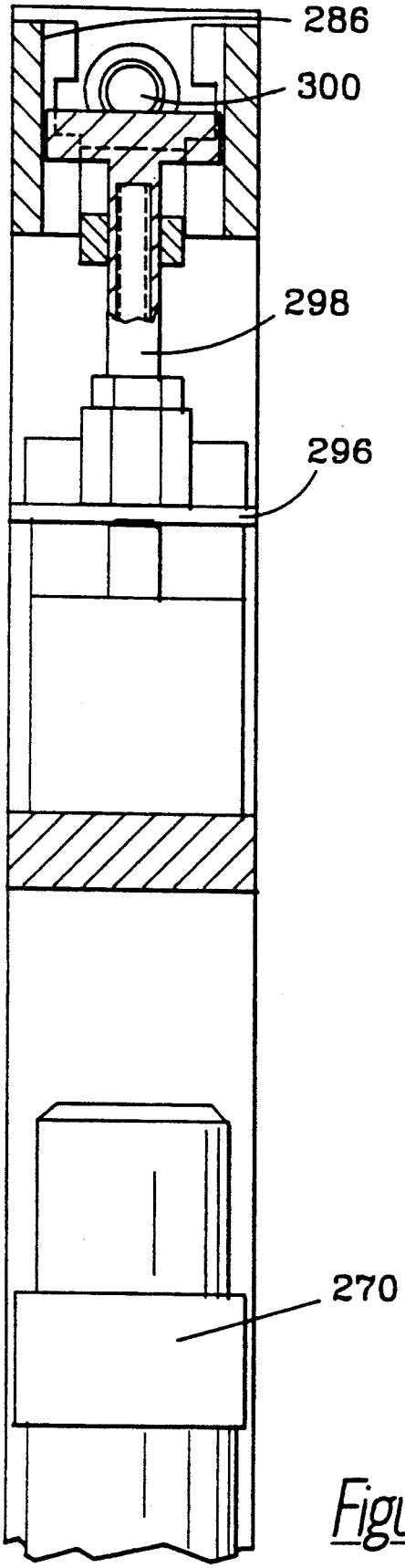
FIG. 33 is a cross-sectional view through lines 33—33 of FIG. 29.

With respect again to FIG. 27, the second elevator member 28 generally comprises an H-shaped frame 258 having vertical leg sections 259 having fixedly attached thereto gib sections 276. Complementary gib sections 278 are fixed to the structural plate section 200 thereby allowing the vertical movement of the second elevator member 28 relative to the structural plate 200, the gib sections 276 and 278 being shown in grater detail in FIG. 32. The second elevator member 28 further comprises a lower air cylinder 262 having a cylinder rod 264, and an upper air cylinder 270 having a cylinder rod 272. The upper air cylinder 270 is fixed to the H-shaped frame 258 at the cross bar 260 while the air cylinder 262 is fixedly attached to the structural plate 200. The two cylinder rods 264, 272 are interconnected one to the other via the coupling member 274 which passes through an aperture in the lower cross bar 261, the combination of the air cylinders 270 and 262 defining a tandem acting air cylinder arrangement.

Figure 29:
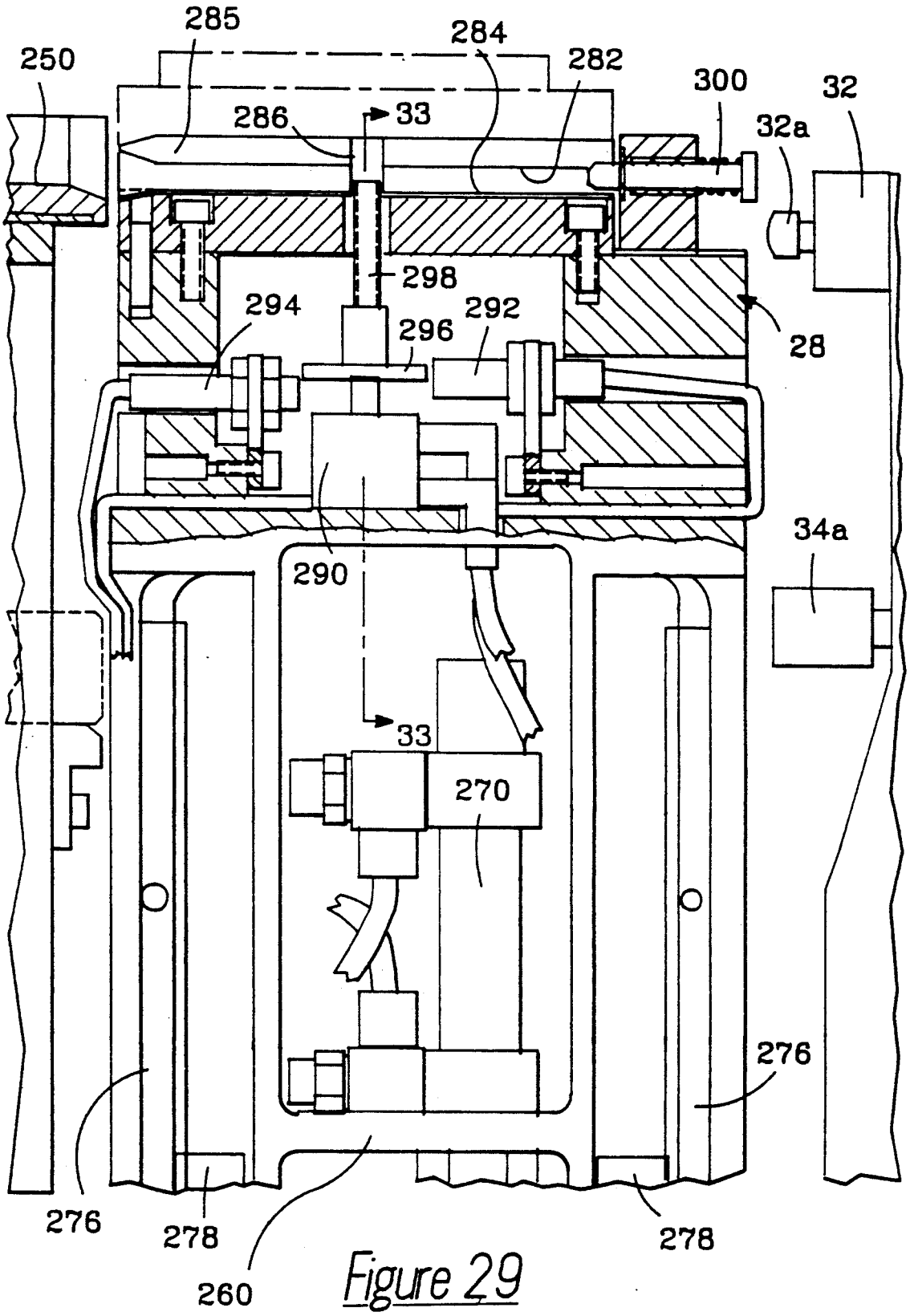
FIG. 29 is a detailed view of the upper half of the second elevator member.

With respect now to FIG. 29, the upper section of the second elevator member 28 is shown as including inner surfaces 282 and 284 thereby defining a rib 285. Beneath the upper surface 284 is an air cylinder 290 having interconnected thereto an indicator plate 296 which is then connected to a T-bar 298. The indicator plate 296 is proximate to two proximity sensors 292 and 294 where the proximity sensors 292 and 294 are vertically offset one from the other. The T-bar section 298 extends upwardly through the lower surface 284 and resides in the transverse slot 286. Aligned with the upper portion of the second elevator section 28 is a spring loaded plunger 300, while an air cylinder 32 is vertically offset from the plunger 300 yet laterally aligned.

Figures 36, 37, 38:
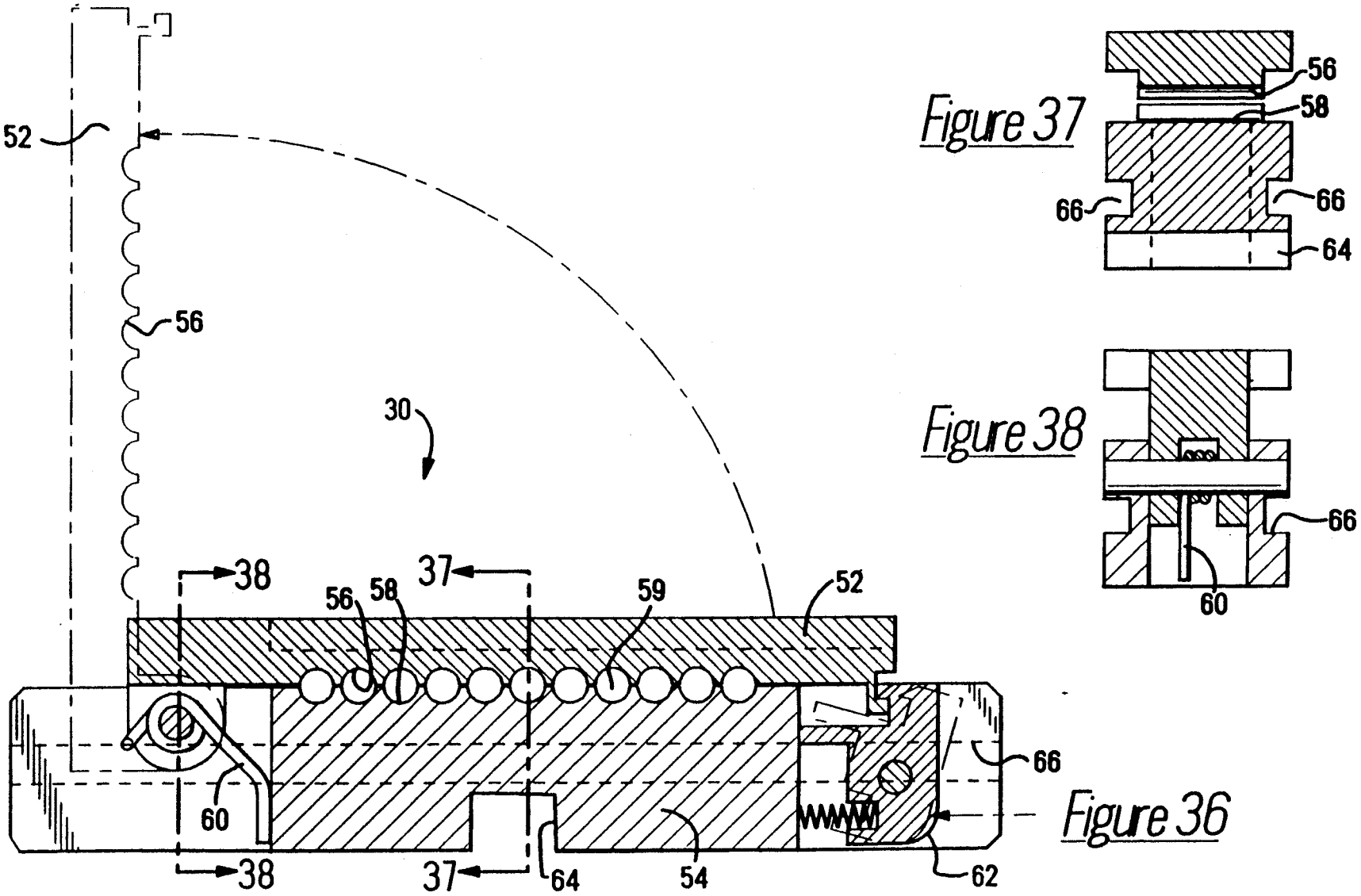
FIG. 36 is a cross-sectional view through the center of an individual shuttle member.
FIG. 37 is a cross-sectional view through lines 37—37 of FIG. 36.
FIG. 38 is a cross-sectional view through lines 38—38 of FIG. 36.

With respect now to FIG. 36, the individual shutter member 30 comprises a lower housing section 54 and an upper section 52 which is rotatable relative to the lower section 54. The lower housing section 54 includes semi-circular grooves 58 while the upper housing part 52 includes semi-circular portions 56 which, when the upper housing section 52 and the lower housing section 54 are aligned, define wire retaining sections 59. The upper housing part 52 is pinned to the lower housing part 54 and includes a torsion spring 60 which spring loads the upper housing part 52 into the open condition as shown in phantom in FIG. 36. At the opposite end, the shuttle member 30 includes a locking member 62 which is spring loaded to retain the upper housing portion 52 in a locked configuration. However, the locking section 62 is rotatable relative to the lower housing section 54 to its phantom position shown in FIG. 36, spring opening the upper housing portion 52. The lower surface of the shuttle member 30 comprises a transverse slot 64 while, as shown in FIG. 37, the shuttle member 30 comprises a longitudinal slot 66 on each sidewall.

DETAILED DESCRIPTION OF THE OPERATION OF THE HARNESS MAKER

Figure 21:
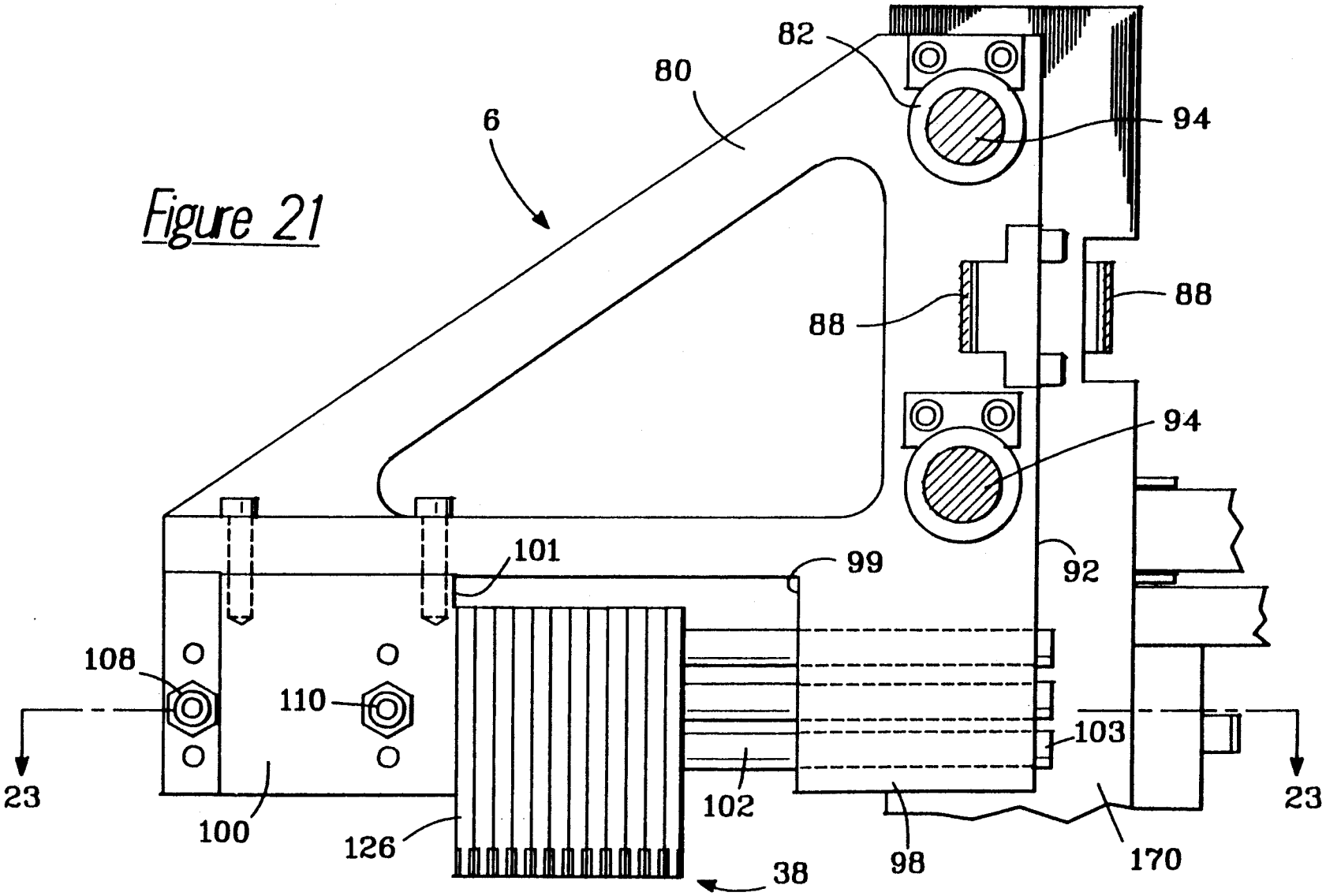
FIG. 21 is a view similar to that of FIG. 19 showing the entire wire gripping apparatus.

With the wire pulling mechanism 6 and the pitch setting mechanism 8 as described above, several different applications can be accomplished with the one machine. For example, if all the wire feeding tubes are to be used in the harness, then when the wire pulling mechanism 6 is moved to the position shown in FIG. 18A, every gripper 38 is actuated which picks up every end of the wire 44. If the wires are to be kept on the same centerline as that fed out of the tubes, then when the wire is pulled from the left position to its rightward most position as shown in FIG. 18A and 18B, the grippers 38 are kept on the same original centerline, as shown in FIG. 21. If less than all the wires are desired in the harness, the individual gripper members 38 can also be independently programmed to pick up any combination of the wires 44 being fed from the tubes 36. Finally, if the wires at the right hand end are to have a different spacing than the spacing as fed from the tube 36, then the pitch setting apparatus 8 in combination with the wire gripping mechanism must be utilized.

To begin in a mode where harnesses are made from the above mentioned machine, and where the pitch is to be different at opposite ends, the desired pitch must be set for the wire ends. It should be understood that by setting the pitch on the ends of the wires, the wire ends will be set for the designated terminals. In other words, the pitch setting operation can set different pitches at the opposite ends of the wires. As mentioned previously, the preferred method includes the sizing of the detente balls to correspond to the pitch between the terminals in connector housing used in the harness.

With respect to FIGS. 18B and 19, the operation of the pitch setting device 8 is such that each of the air cylinders 156 is actuable to move the stop pins 152 to set the spacing of the individual end faces of the stop pins 152. To move a stop pin forward, the air cylinder 156 is actuated which lifts the pin 160 upwardly out of the bore 164. Due to the spring force from the spring 164, one of the detente balls 166, which was previously to the right of the moveable pin 160, is moved to the left. The moveable pin 160 is then reinserted into the bore 164 and, due to the chamfered face on pin 160, the pin pushes one more ball to the left side of the pin 160, which pushes the pin 152 to the left. When the pin 152 is pushed to the left, the detente spring 154 gives way, and the pin 152 is detente from the first to the second detente notch 158. It should be noted that the detente pin 154 has a spring loaded pin which is strong enough to hold the pin 152 in its position while the moveable pin 160 is retracted, but which is not strong enough to withstand the reinsertion of the moveable pin 160 into the bore 164 and the longitudinal force due to the movement of the further detente ball 166.

It should be understood then that many combinations of pitch settings are possible. For example, the harness maker can be set for no pitch change, the machine can be set for a situation where every other terminal is skipped, or the harness maker can be set to skip several terminal and then begin in another pattern.

Figure 34:
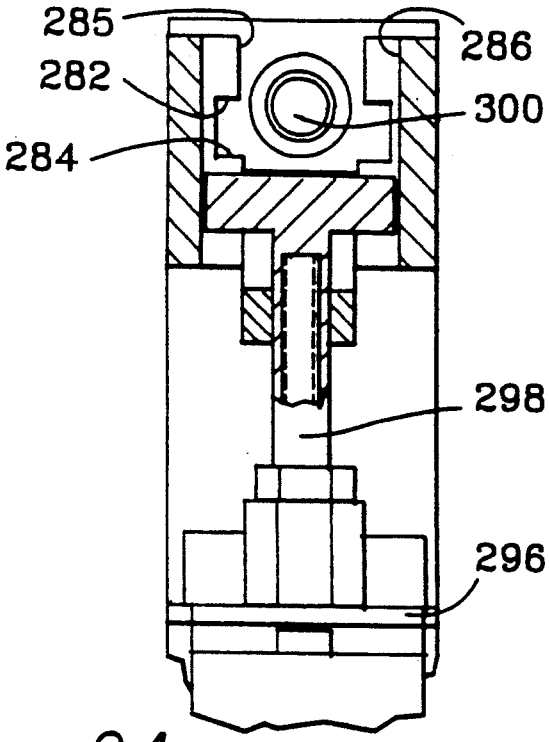
FIG. 34 is a cross-sectional view similar to that of FIG. 33 showing the T bar in an unactuated position.
Figure 35:
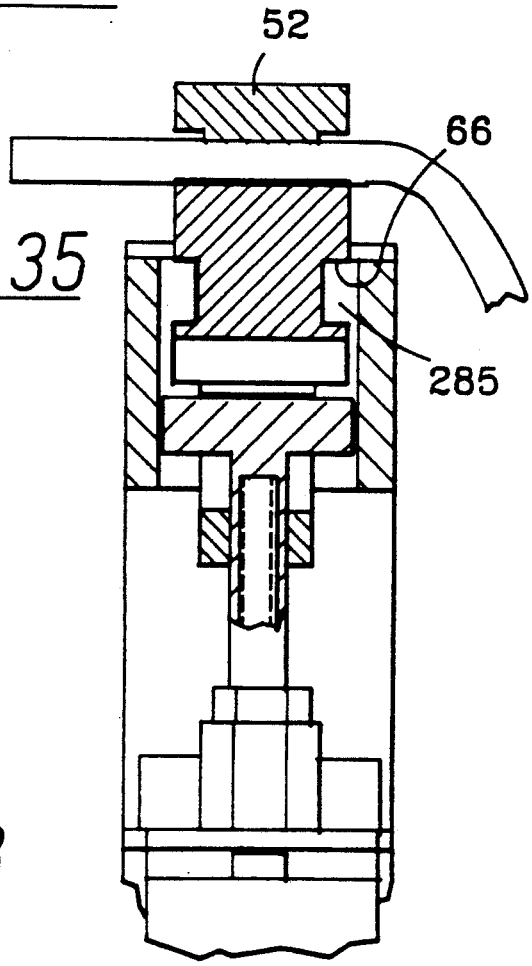
FIG. 35 is a view similar to that of FIG. 34 showing the shuttle in place on the upper surface of the elevator.

With the pitch set, the wire gripping mechanism can begin in the harness making mode. The elevators 26, 28 (FIG. 27) are set in the position where the upper portions of both elevators are aligned with the lower surface 252 (FIG. 27) of the shuttle mechanism. The shuttle 30 on the first elevator is placed on the upper section of the elevator with the grooves 66 (FIG. 37) in slidable relation with the rib 225 (FIG. 28). The shuttle on the second elevator member 28 has its groove 66 in slidable relation with the rib 285 (FIG. 34). The upper housing portions 52 of each of the shuttles 30 are in open their open positions.

The wire gripping mechanism 6 is moved to its leftward most position as shown in FIG. 18A, where the individual gripper members 38 grip the individual wires 44. With the piston rod of the piston 145 fully retracted, such that the housing part 146 is moved to its right most position as shown in FIG. 19, the housing member 80 of the wire gripping mechanism 6 is moved to its right most position where the plurality of stop pins 102 are aligned with the preset stop pins 152. In this position, the wire is spanning both sets of tracks 18, as shown diagrammatically in FIG. 9. The housing part 146 is now moved from the position shown in FIG. 19 to the position shown in FIG. 20, which moves the pins 152 closer to the stop rods 102. To move the stop rods into the pins 152, air pressure is subjected to the air inlet 108

(FIG. 23) to pressurize the diaphragms 107 of the individual pistons 106. This air pressure pushes the individual air pistons 106 and their associated gripper plates 120, carrying with them the wires 44, towards surface 99 until the ends of the stop pins 102 abut the ends of the pins 152, as best shown in FIG. 23. The wire ends are now prepared as shown in FIGS. 9–11 which lengthens and combs the wires.

With the wire gripping plates 120 to their spread condition, the first elevator member 26 is now moved upwardly which moves the shuttle member 30, which is on top of the elevator 26, upwardly such that the wire ends 44 are placed within the semi-circular openings 58 in a lower housing portion 54 of the shuttle member 30. The upper housing part 52 of the shuttle member 30 is now closed via the actuator member 46 (FIG. 3) which closes the upper housing part 52 and snap latches the upper housing part 52 to the lower housing part 54 via the lock mechanism 62. With the first elevator portion 26 as shown in FIG. 28 in its upward most position, and with the upper cover 52 in its latched position, the air cylinder 230 is now actuated which moves the indicator 231 from adjacent the proximity probe 232 to a position proximate to the proximity probe 234 which moves the T-plate 236 downwardly and out of alignment with slot 64 in the bottom of the shuttle member 30.

With the second elevator member 28, in its full upright position as shown in FIG. 29, and with the T-bar 298 in the downward position such that the indicator plate 296 is adjacent to the proximity probe 294, the push rod 10 is actuated which pushes the shuttle member 30 which is on top of the elevator member 26 to a position on top of the surface 250 of the upper rail member 24. Since the upper rail 24 includes a plurality of abutting shuttle members 30, the movement of the shuttle member 30 to the right pushes all of the downstream shuttle members to the right, as viewed in FIG. 27, by a distance equal to the length of one shuttle member. This moves a rightward most shuttle member 30 onto the top surface of the second elevator member 28. With respect to FIG. 29, the air cylinder 290 is now actuated which moves the indicator plate from a position proximate to the probe 294, to the position shown in FIG. 29 which moves the T-bar into the slot 64 of the shuttle member 30, thereby assuring the longitudinal alignment of the shuttle member 30 relative to the elevator 28.

Figure 30:
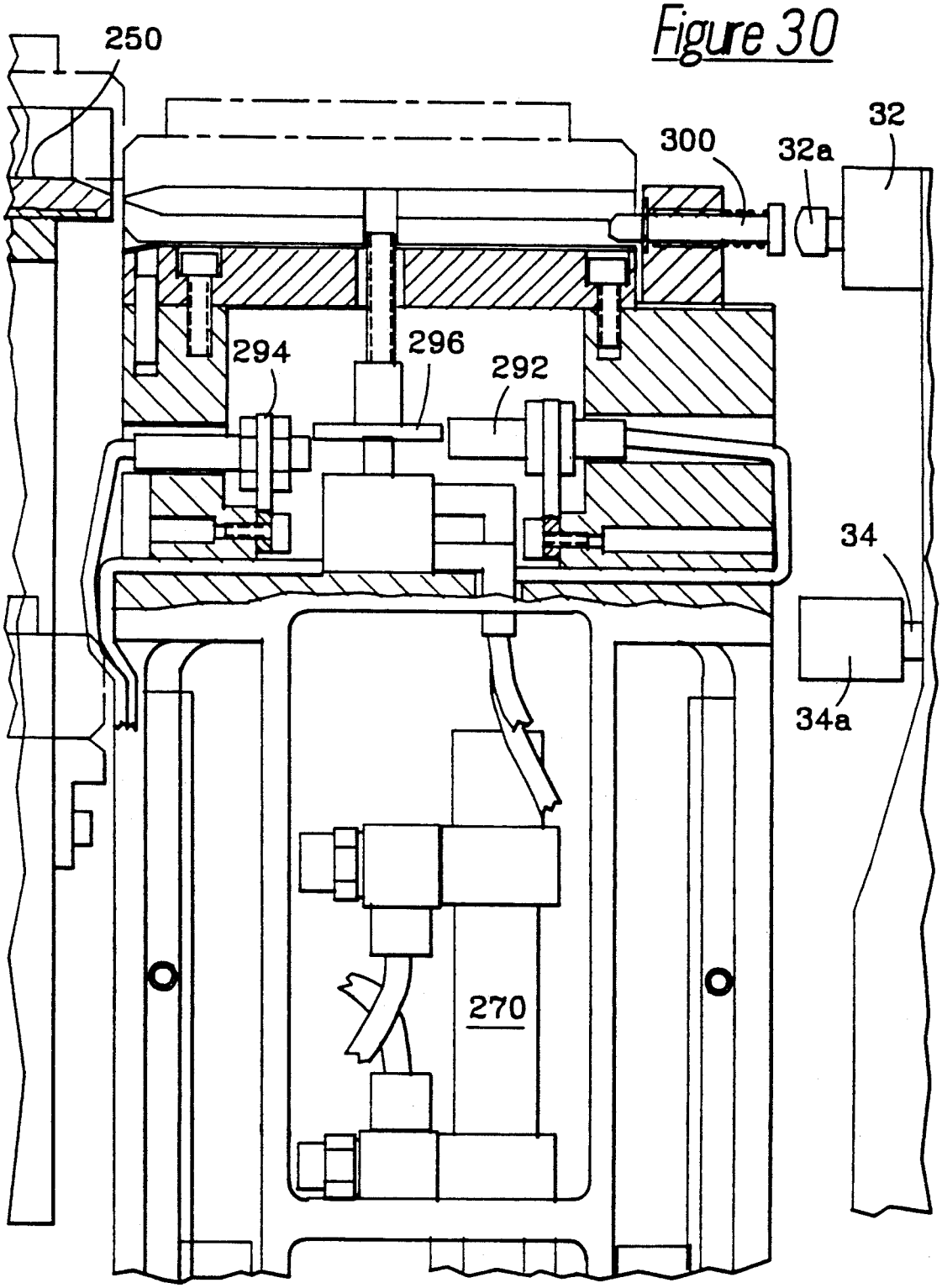
FIG. 30 is a view similar to that of FIG. 29 showing the second elevator in its first lowered position.

The first air cylinder 270 of the second elevator member 28 may now be actuated which moves the H-shaped frame 258 from a position as shown in FIG. 29 to a position shown in FIG. 30 where the plunger 300 is aligned with push rod **32*a* of the air cylinder 32. This also moves the wire bundle retained by the shuttle members 30 downwardly into the insulation displacement portions of the terminals in the connectors as previously described. As previously described, when the shuttle member 30 is aligned with the second elevator member 28 as shown in FIG. 30, the wire ends are also aligned with a crimp mechanism 20 as shown in FIG. 1. After the crimping operation, the air cylinder 32 is activated which pushes the push rod 32*a* forwardly into the plunger 300 as shown in FIG. 30 thereby activating the latch mechanism 62 as shown in FIG. 36 causing the upper housing part 52 to spring open to its position shown in FIG. 36** in phantom.

Figure 31:
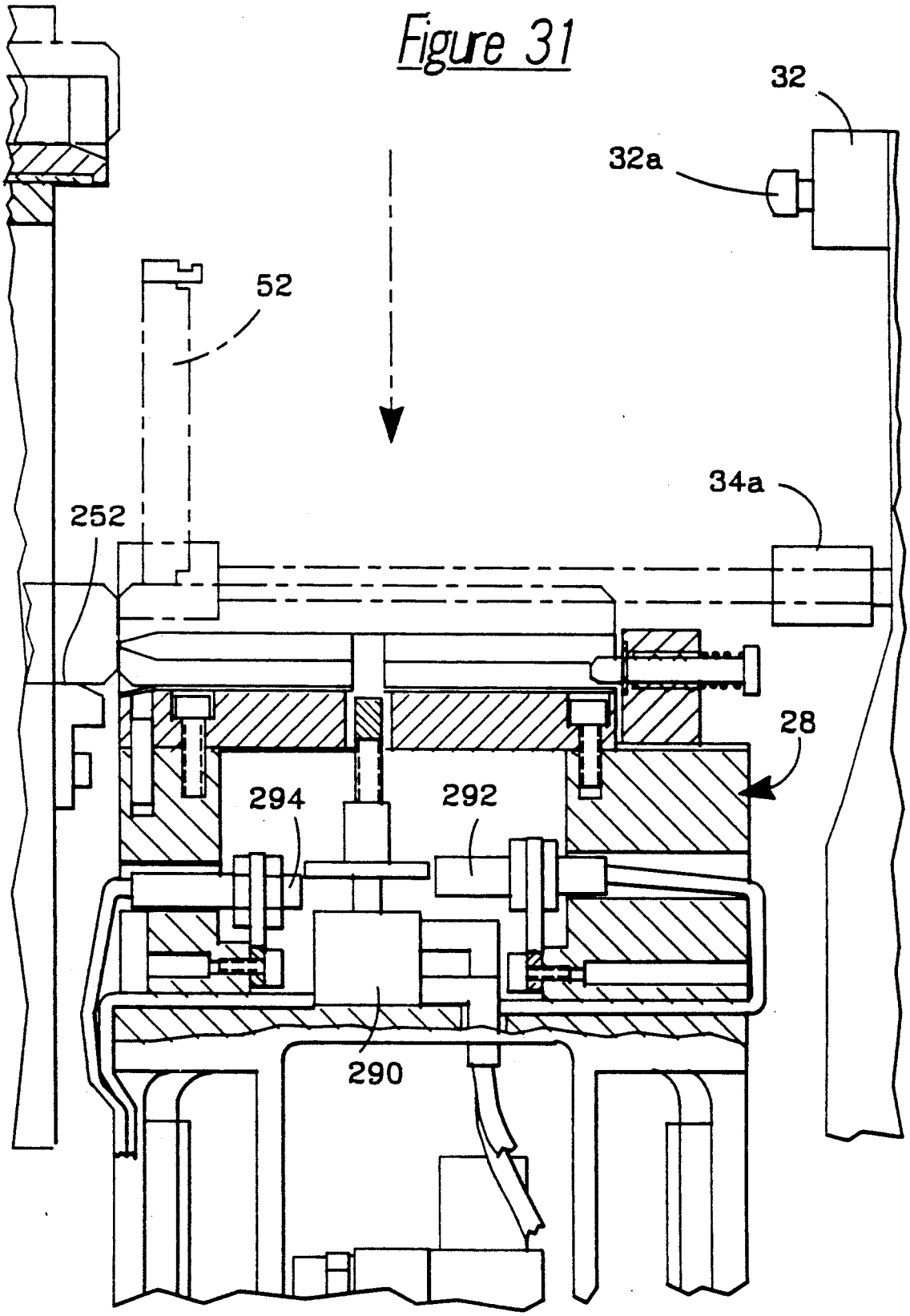
FIG. 31 is a view similar to that of FIG. 30 showing the second elevator in, its second lowered position vertically aligned with the lower track.

After the crimping operation, the air cylinder 262 (FIG. 27) is actuated which pulls the cylinder rod 264 downwardly thereby pulling the H-shaped frame 258 downwardly to the position where the shuttle mechanism 30 is aligned with the upper surface 252 of the lower track 22. With the elevator member 26 again in its lowermost position, where the upper surface of the elevator member 26 is aligned with the upper surface 252 of the lower track member 22, the air cylinder 34 is actuated causing the push rod **34*a* to extend to the position shown in phantom in FIG. 31 thereby pushing all of the shuttle members 30 towards the elevator member 26 and pushing the last shuttle member 30 onto the top surface of the elevator member 26**.

Figure 20:
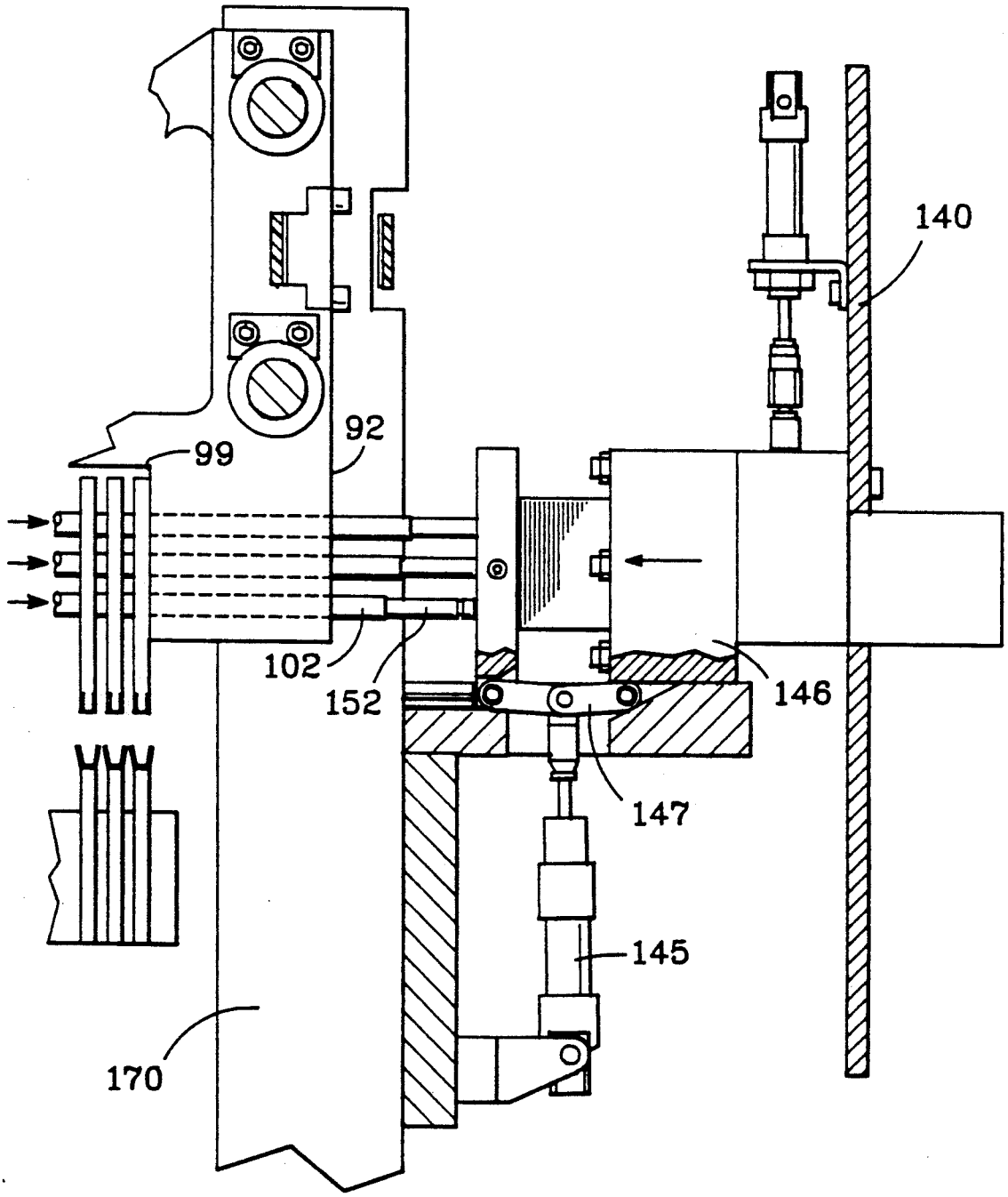
FIG. 20 is a view similar to FIG. 19 showing the wire spreading mechanism is an activated condition.

With a new shuttle member 30 on the top surface of the elevator member 26, the upper housing part 146 is moved from its position shown in FIG. 20 to its retracted position as shown in FIG. 19 and the air passage 110 (FIG. 23) is actuated which puts pressure on the back side of the individual diaphragms 107 thereby retracting the individual gripper members 38 to their left justified position as shown in FIG. 21. The air cylinder 145 is again retracted which pulls the pins 152 away from the stop pins 102. The stepper motor 90 may now be activated in the reverse direction to move the housing member 80 to its starting position **18*a* to create a new wire bundle, and move them to the new set of shuttle members 30**.

We claim:

1. A wire transfer station comprising:

an upper wire transfer track having wire shuttle means disposed thereon and moveable relative thereto;

a lower wire transfer track having wire shuttle means disposed thereon and moveable relative thereto;

a forward elevator mechanism which is moveable from the lower wire transfer track to the upper wire transfer track;

a rearward elevator mechanism which is moveable from the upper wire transfer track to the lower transfer track;

first pusher means adjacent to the forward elevator mechanism and the upper wire transfer track, for moving the wire shuttle means towards the rearward elevator member; and second pusher means adjacent to the rearward elevator mechanism and the lower wire transfer track, for moving the wire shuttle means towards the forward elevator mechanism.

2. A wire harness making apparatus, comprising:

two upper wire transfer tracks extending parallel to each other, each track having first and second ends;

shuttle members moveable along said upperwire transfer tracks to move wires from said first ends to said second ends;

a wire feed mechanism adapted to feed wires along a wire feed direction transverse to said tracks, to positions spanning said upper wire transfer tracks, and into said shuttle members with free ends of said wires extending from said shuttle members;

connector housing feed mechanisms adjacent to the shuttle members to locate the connector housings proximate to the wire ends;

connector feed tracks positioned outside of and extending parallel to, said upper wire transfer tracks; and termination members positioned over said connector feed tracks to position said wire ends in said connector housings.

3. The wire harness making machine of claim 2 wherein two lower wire transfer tracks are positioned below said upper wire transfer tracks, and elevator mechanisms are positioned at both ends of wire transfer tracks whereby said shuttle members move in a continuous loop around said upper and lower wire transfer tracks.

4. The wire harness making machine of claim 2 wherein pusher members are positioned at said first ends of said upper wire transfer tracks, adapted to push said shuttle members toward said second end.

5. The wire harness making machine of claim 4 wherein, the pusher members are adapted to move said shuttle members the length of one shuttle member, whereby the shuttle members are positioned on the wire tracks, and each shuttle member pushes the consecutive shuttle member upon activation of said pusher members.

6. The wire harness making machine of claim 2, whereby wire alignment comb members are positioned adjacent to said first end of said upper wire transfer tracks, whereby said wires are aligned in proper disposition in said shuttle members.

7. The wire harness making machine of claim 2, whereby said upper wire transfer tracks are positioned above said connector feed tracks, whereby said wire ends are positioned over said connectors in said connector feed tracks.

8. The wire harness making machine of claim 2, wherein two connector feed mechanisms are included, each feed mechanism adapted to move connector housings transversely of said connector feed tracks, to a position proximate to said connector feed tracks.

9. A wire transfer station comprising:

an upper wire transfer track having wire shuttle members disposed thereon and moveable relative thereto;

a lower wire transfer track having wire shuttle members disposed thereon and moveable relative thereto;

a forward elevator mechanism which is moveable between the lower wire transfer track and the upper wire transfer track;

a rearward elevator mechanism which is moveable between the upper wire transfer track to the lower transfer track;

a first pusher member adjacent to the forward elevator mechanism and the upper wire transfer track, for moving the wire shuttle means towards the rearward elevator member; and a second pusher member adjacent to the rearward elevator mechanism and the lower wire transfer track, for moving the wire shuttle means towards the forward elevator mechanism, whereby said wire shuttle members on said upper and lower wire transfer track are continuously cycled around said upper and lower tracks.

10. The wire transfer station of claim 9, wherein said wire shuttle members have a wire receiving base portion, and an upper cover part, where by said wire receiving base and said upper cover part form wire receiving through openings therethrough.

11. The wire transfer station of claim 10, wherein said upper cover part is spring loaded into a normally open position, and latched into a closed position.

12. The wire transfer station of claim 11, further comprising means to unlatch said upper cover part, when said wire shuttle members are proximate to said rearward elevator mechanism.

13. The wire transfer station of claim 9, wherein two upper wire transfer tracks are positioned in a parallel manner, with two lower wire transfer tracks positioned directly therebeneath.

14. The wire transfer station of claim 13 further comprising a wire feed mechanism moveable transversely of said two upper wire transfer tracks, and profiled to position lengths of wires in said upper wire shuttle members, for the production of wire harnesses.

15. The wire transfer station of claim 14, further comprising connector housing feed tracks positioned along side said upper wire transfer tracks, said connector housings being moveable with said shuttle members to dispose connector housings adjacent to said wires to be terminated.

16. The wire transfer station of claim 15, wherein said connector housing feed tracks are disposed on an outside of said upper wire transfer tracks, and are lower than said wire transfer tracks, said rearward elevator mechanism having a two stage operation, whereby said first stage lowers said wires into said connector housings, and said second stage lowers said shuttles to said lower wire track.

17. The wire transfer station of claim 16, wherein said wire shuttles are of two part construction comprising a wire receiving base portion and an upper cover part, each shuttle member having a latch member for opening said upper cover part.

18. The wire transfer station of claim 15 wherein said upper cover part is spring loaded into an open position to expose said wire receiving base portion.

19. The wire transfer station of claim 17, further comprising an actuator member for actuating said latch member when said wire shuttles are in said first stage position, and after said wires are terminated into said connectors, the shuttles being thereafter moveable downwardly through said second stage, free of said wires, to leave a completed harness in said connector feed tracks.

* * * * *